US005162853A

United States Patent [19]

Ito et al.

[11] Patent Number: 5,162,853

[45] Date of Patent: Nov. 10, 1992

[54] MULTIPLE COLOR COPYING APPARATUS HAVING A COPY PAPER COLOR DETECTING DEVICE

[75] Inventors: Masazumi Ito; Minoru Nakamura; Toru Kasamatsu; Kenzo Nagata; Yoichi Kawabuchi; Syuzi Maruta; Hiroyuki Ideyama, all of Osaka, Japan

[73] Assignee: Minolta Camera Kabushiki Kaisha, Osaka, Japan

[21] Appl. No.: 233,030

[22] Filed: Aug. 17, 1988

[30] Foreign Application Priority Data

| | | | |
|---|---|---|---|
| Aug. 21, 1987 | [JP] | Japan | 62-208697 |
| Aug. 21, 1987 | [JP] | Japan | 62-208698 |
| Sep. 29, 1987 | [JP] | Japan | 62-244726 |
| Sep. 29, 1987 | [JP] | Japan | 62-244727 |

[51] Int. Cl.[5] ..... G03G 15/01; G03G 21/00

[52] U.S. Cl. ..... 355/245; 355/311; 355/326

[58] Field of Search ..... 355/245, 251, 253, 259, 355/326, 327, 328, 311

[56] References Cited

U.S. PATENT DOCUMENTS

| | | | |
|---|---|---|---|
| 4,847,658 | 7/1989 | Takebe et al. | 355/245 |
| 4,862,216 | 8/1989 | Higashi et al. | 355/245 X |
| 4,866,486 | 9/1989 | Higashio et al. | 355/326 |
| 4,884,096 | 11/1989 | Kusuda et al. | 355/326 X |
| 4,885,611 | 12/1989 | Higashio et al. | 355/245 |
| 4,897,697 | 1/1990 | Ito et al. | 355/326 |

FOREIGN PATENT DOCUMENTS

| | | | |
|---|---|---|---|
| 60-212778 | 10/1985 | Japan | 355/311 |
| 61-203474 | 9/1986 | Japan | 355/245 |

*Primary Examiner*—Fred L. Braun

*Attorney, Agent, or Firm*—Burns, Doane, Swecker & Mathis

[57] ABSTRACT

A multiple color image forming apparatus, wherein colors or kinds of copying paper contained in paper feed cassettes as well as colors of developers contained in a plurality of developing devices are detected to prevent image forming, which is indistinguishable due to mismatching between the color or kind of copying paper and the color of developer, and the developing device containing the developer of suitable color for the color or kind of copying paper is automatically selected in response to the detected result of the color or kind of copying paper and the color of developer to prevent misforming of the image and to improve the operation easiness.

13 Claims, 24 Drawing Sheets

MULTIPLE COLOR COPYING APPARATUS HAVING A COPY PAPER COLOR DETECTING DEVICE

BACKGROUND OF THE INVENTION

1. Field of the Invention

The present invention relates to a multiple color image forming apparatus having a plurality of developing devices, and more particularly, it relates to a multiple color forming apparatus which detects colors or kinds of copying paper as well as colors of toner to select the developing device responsive to the color or kind of copying paper in response to the detected result.

2. Description of the Prior Art

Conventionally, in a copying machine as one of the image forming apparatus, an image was copied on a "white" copying paper using a "black" toner, in general. However, recently, many kinds of colored toner such as "red", "blue" and "white", and many kind of colored copying paper such as "red", "brown" and "black" are being offered. And so-called color copying in which the colored image is copied on the colored copying paper, has been popularized and utilized.

Now, in such a color copying, a developing device containing the toner of different color from that of the copying paper each other must be installed or selected to copy the image clearly, such as copying the "white" image on the "black" copying paper. That is, when the copying paper and toner are the same color, for example, "black", the copied image could not be ascertained, which results in a problem of miscopying. When the copying paper and toner are of a similar color, the copied image is also difficult to ascertain, which was unfavorable. Thus, at color copying, in order to avoid the foregoing problems, an operator should have operated the machine after confirming in advance that the toner contained in the developing device of the copying machine had the color different from that of the copying paper to be copied and possibly the complementary color or the color close to it.

Recently, the copying machine has been used to form an image on a transparent sheet used for an OHP (overhead projector). The transparent sheet for OHP is usually handled in the dark as it is used for projection. Thus, the image, such as characters or the like, is easily visible and the transparent sheet is easy for an operator to handle, when a bright toner such as white or a fluorescent one is used for development rather than a black toner.

SUMMARY OF THE INVENTION

The present invention is directed to solving the abovementioned prior art problems, and therefore, it is an object of the present invention to provide a multiple color image forming apparatus, in which colors of copying paper and a developer are detected to prevent forming of a copied image by the indistinguishable developer irrespective of the color of the copying paper.

It is another object of the present invention to provide a multiple color image forming apparatus, in which the relation between colors of the copying paper and developer is selected automatically and suitably to prevent miscopying wherein the image can not be ascertained and to obtain the clearer image.

The above and further objects and features of the invention will more fully be apparent from the following detailed description with accompanying drawings.

DESCRIPTION OF THE PREFERRED EMBODIMENTS

Figure 1:
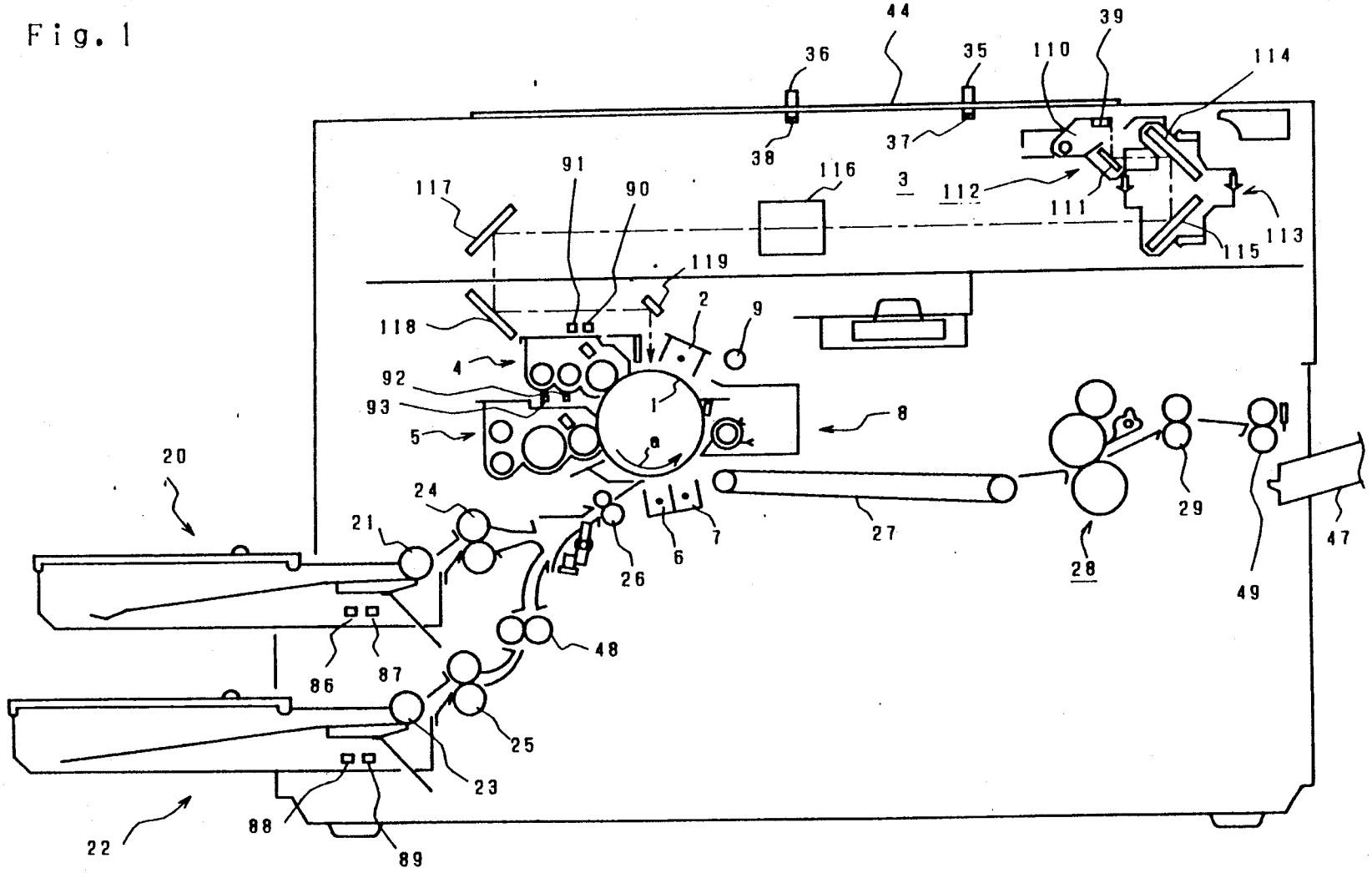
FIG. 1 is a schematic sectional view showing the construction of one embodiment of a copying machine as a multiple color image forming apparatus according to the present invention.

FIG. 1 is a schematic sectional view showing a copying machine of a first embodiment according to the present invention.

As shown in FIG. 1, the copying machine according to the present embodiment includes an image forming portion with a photosensitive drum 1 as the main part generally in the center thereof. Above the image forming portion, an optical system 3 for exposing and scanning an original is arranged, and on the left and right sides of the copying machine, a paper feeder and a fixing and discharging portion are disposed respectively. The photosensitive drum 1 is rotatably pivoted in the image forming portion, and a charger 2, first developing device 4, second developing device 5, transfer charger 6, separation charger 7, cleaning device 8 and eraser lamp 9 are disposed successively along its circumference in its rotational direction (in the direction of the arrow a).

In the image forming portion, first, the surface of the photosensitive drum 1 is constantly charged by the charger 2, and an electrostatic latent image is formed by light irradiated from the optical system 3.

The optical system 3 is installed to scan an original image of the original placed on an original glass 44 from thereunder, and constituted by a scanning unit 112 comprising a slit-exposure type light source 110 and first movable mirror 111 integrated in one unit, second and third movable mirrors 114, 115 held by a common holder 113, a variable magnification lens 116 and mirrors 117, 118, 119. At one upper end of the scanning unit 112, a reed switch 39 is disposed.

The scanning unit 112 is driven by a DC motor not shown to move leftward at the speed of (v/m) (where m:copying magnification) relative to the circumferential speed (v) (constant irrespective of equimultiple or variable magnitude) of the photosensitive drum 1, and the common holder 113 is to move leftward at the speed of (v/2 m). When changing the copying magnification, a certain operation is performed, for example, the lens 116 is moved along an optical axis by a stepping motor, not shown here.

By such a scanning of the original image by the optical system 3, the optical image responsive to the original image is irradiated on the photosensitive drum 1 to form the electrostatic latent image. As is described later, the toner is supplied to the electrostatic latent image to make it visible by selectively actuating the first developing device 4 or the second developing device 5.

Meanwhile, in the first developing device 4, a developer composed of a magnetic carrier and an insulated color toner is contained, and in the second developing device 5, a developer composed of the magnetic carrier and a usually used black toner is contained. It is possible to select any toner color by exchanging the whole developing device.

On the side of the first developing device 4 in the copying machine, a toner color discriminating sensor including reed switches 90, 91 is disposed, and by ON/-OFF status of these switches, the toner color in the first developing device 4 is detected. Similarly, on the side of the second developing device 5 in the copying machine, a toner color discriminating sensor including reed switches 92, 93 is disposed.

The paper feed device comprises a first paper feeder 20 including a paper feed roller 21 and a second paper feeder 22 including a paper feed roller 23. A conveying passage of the copying paper is constituted by pairs of rollers 24, 25, and 48, a pair of timing rollers 26, conveying belt 27, fixing device 28 and pairs of discharging rollers 29, 49.

The pair of timing rollers 26 send out the copying paper fed from the paper feed device to the vicinity of the photosensitive drum 1 and align its front end with the toner image forming area formed on the photosensitive drum 1. The copying paper thus sent out is transferred with the toner image by the transfer charger 6, separated from the surface of the photosensitive drum 1 by the separation charger 7 and discharged through the conveying belt 27 to a discharging tray 47 outside the machine by the discharging rollers 29, 49, after the toner is melted and fixed by the fixing device 28.

After the toner image transferred paper has been separated, the residual toner on the surface of the photosensitive drum 1 is scraped off by the cleaning device 8. In addition, the residual charge is erased by the light irradiated from the eraser lamp 9 to prepare for the next image formation.

Figure 2:
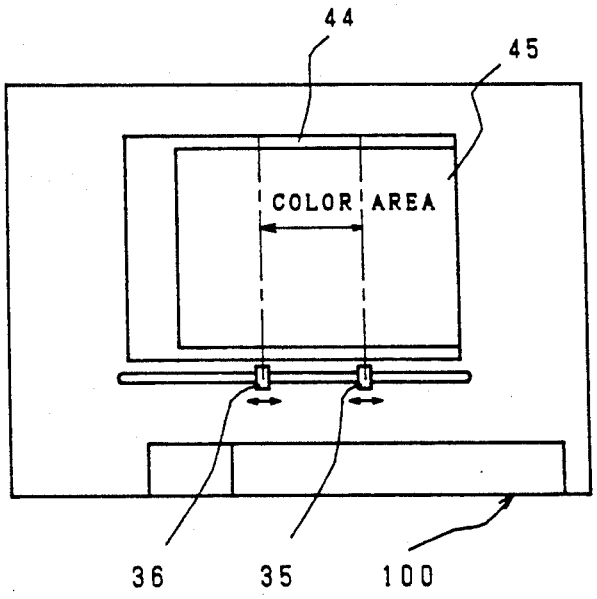
FIG. 2 is a plan view showing the upper portion of a copying machine of the present invention.

FIG. 2 is a plan view showing the upper portion of the copying machine. In the upper front portion of the copying machine, the original glass 44, first and second levers 35, 36 for designating the color area and operating panel 100 are arranged.

The first and second levers 35, 36 are respectively disposed movably in the lengthwise direction of the original glass 44 to form, in the present embodiment, a space between the first and second levers 35, 36 where the color development (by the first developing device 4) is performed. As shown in FIG. 1, a magnet 37 is installed under the first lever 35 and a magnet 38 under the second lever 36. When the reed switch 39 situated on the scanning unit 112 moves as far as the magnet 37 or 38, it is ON to detect the positions of the first and second levers 35, 36 as is described later.

Next, the construction and operation of the first and second developing devices 4, 5 will be explained in conjunction with FIG. 3 through FIG. 6.

Figure 3:
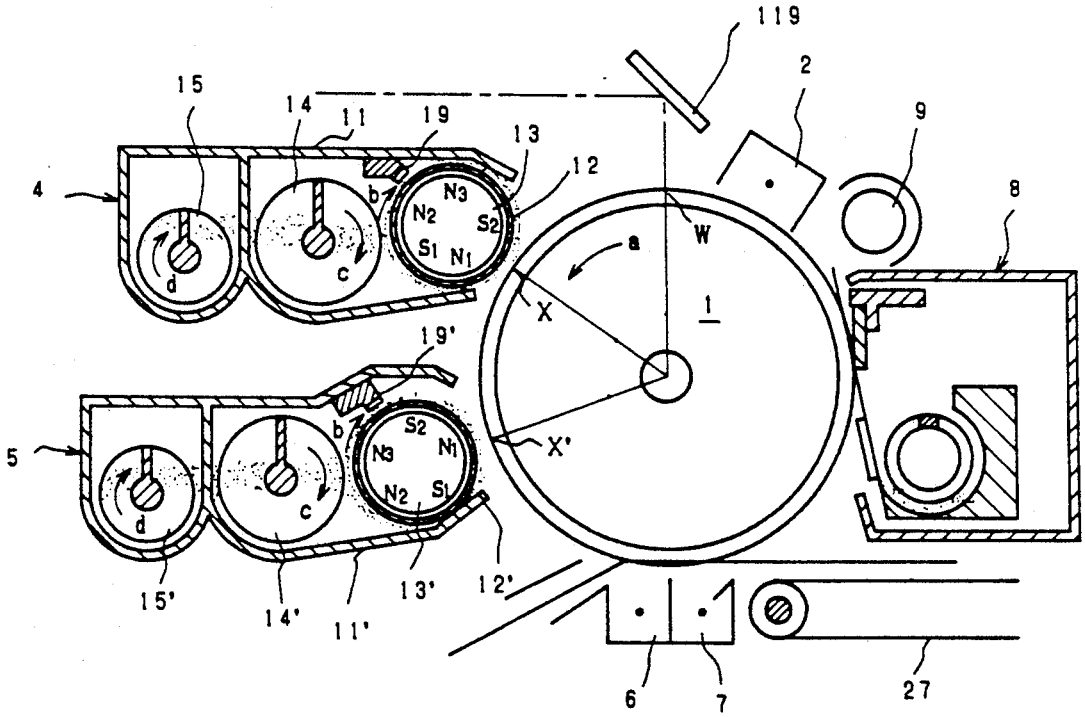
FIG. 3 is an enlarged sectional view showing the construction of a photosensitive drum and its peripheral equipment.
Figure 4:
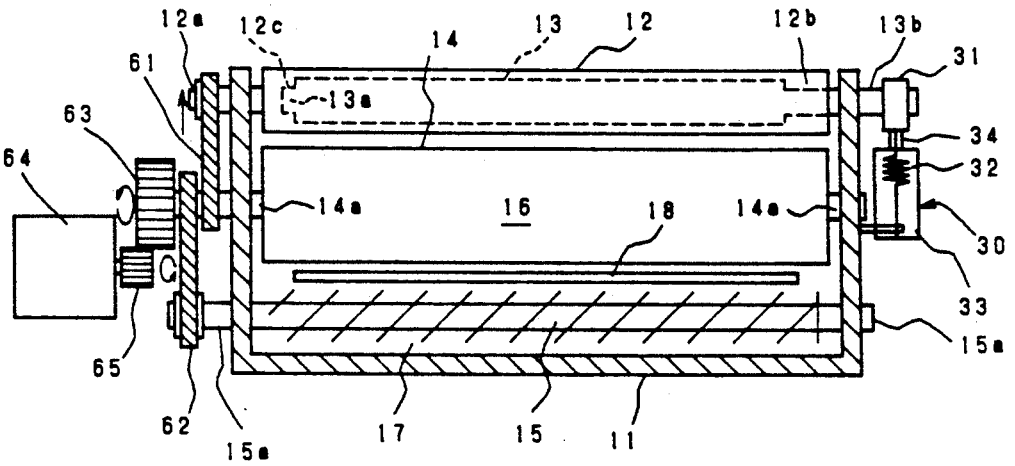
FIG. 4 is a transverse sectional view of a first developing device.

Since the second developing device 5 is similarly constructed to the first developing device 4, the latter will be cited for explanation. As shown in FIGS. 3 and 4, the first developing device 4 is comprised of a developing tank 11, sleeve roller 12, magnet roller 13, supply roller 14 and screw 15.

In the first developing device 4, the screw 15 is rotated in the clockwise direction d to convey the toner supplied from a toner bottle, not shown, toward the supply roller 14, and supported by side walls of the developing tank 11 at the opposite ends of its support shaft 15*a*.

The supply roller 14 is rotated in the clockwise direction c to mix and stir the toner and carrier, and to supply the developer to the sleeve roller 12, and supported by the side walls of the developing tank 11 at the opposite ends of its support shaft 14*a*.

The supply roller 14 and screw 15 are respectively disposed in conveying passages 16, 17 partitioned by a partitioning wall 18, and the conveying passages 16, 17 communicate with each other at both ends of the developing tank 11.

The sleeve roller 12 is formed by a non-magnetic conductive material and incorporates the magnet roller 13. The sleeve roller 12 rotates independently from the magnet roller 13 in the clockwise direction b to supply the toner supplied by the supply roller 14 to the developing area on the photosensitive drum. The sleeve roller 12 is supported by one side end of the developing tank 11 at a support shaft 12*a*, and by a support shaft 13*b* of the magnet roller 13 at a bearing 12*b*.

In the first developing device 4, a belt 61 is installed on the support shaft 12*a* of the sleeve roller 12 and the support shaft 14*a* of the supply roller 14, and a belt 62 on the support shaft 14*a* of the supply roller 14 and a support shaft 15*a* of the screw 15.

On one end of the support shaft 14*a* of the supply roller 14, there is mounted a gear 63 which meshes with a drive gear 65 of a first developing device motor 64.

Thus, when the first developing device motor 64 is driven to rotate the drive gear 65 in the direction of full lines shown in FIG. 4, the gear 63 and belts 61, 62 are respectively rotated in the full line direction to rotate the sleeve roller 12, supply roller 14 and screw 15 respectively in the directions shown by the arrows b, c and d.

Behind the developing area of the sleeve roller 12, a developer height restricting member 19 installed on the upper inside surface of the developing tank 11 is disposed.

The magnet roller 13 is incorporated in the sleeve roller 12 and comprises a plurality of magnets arranged axially. Five poles (N1 to N3, S1, S2) of the magnetic poles located on the peripheral surface of the magnets are asymmetrical, in which N1 is given the most intensive magnetic force as the main pole such that, at development, it takes place at the position opposed thereto. The magnet roller 13 is supported by a concave bearing 12*c* provided in the sleeve roller 12 at one end 13*a* of its support shaft and by the side wall of the developing tank 11 at the other end 13*b*, and rotatable by the prescribed angle ($\theta=40°$) by a magnet roller displacing means 30 to be described below in detail.

Figure 5:
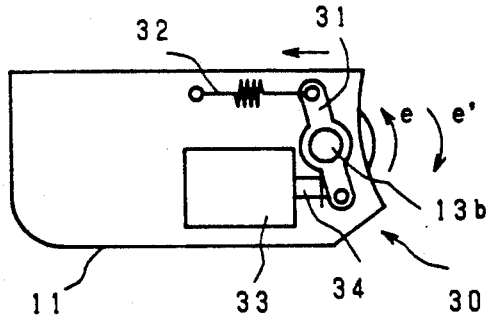
FIGS. 5 and 6 are longitudinal sectional views showing the operation of the first developing device respectively at developing and non-developing.
Figure 6:
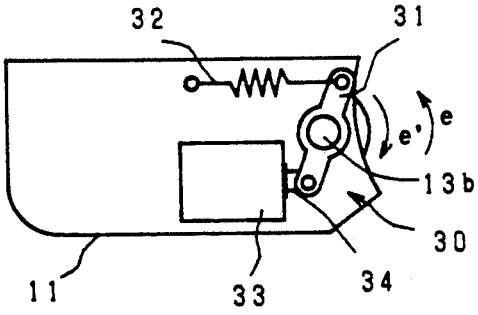

The displacing means 30 of the magnet roller 13, as shown in FIGS. 5 and 6, is comprised of a lever 31, spring 32 and solenoid 33. The lever 31 is fixed to the end of support shaft 13*b* of the magnet roller 13 at the center, and the spring 32 fixed to the developing tank 11 is mounted at one end thereof so as to always be urged in the direction e. A plunger 34 of the solenoid 33 is engaged to the other end of lever 31 which is rotated in the direction e' against the urging force of the spring 32 when the solenoid 33 is actuated.

When the solenoid 33 is not actuated (OFF) or the lever 31 is in the state shown in FIG. 5, the magnetic pole N1 of the magnet roller 13 opposes the photosensitive drum 1.

Conversely, when the solenoid 33 is actuated (ON) or the lever 31 is in the state shown in FIG. 6, an intermediate portion between the magnetic poles S1 and N1 of the magnet roller 13 opposes the photosensitive drum 1.

In the aforesaid developing device, at developing (refer to the second developing device 5 in FIG. 3), the magnetic pole N1 is positioned to oppose the developing are X' (solenoid 33' is OFF), and when the sleeve roller 12 is rotated in the clockwise direction b (motor 24' is ON), the developer supplied by the supply roller 14 forms a standard developer height by the developer height restricting member 19 and magnetic poles N3, S2. Next, in the area X' on the photosensitive drum 1 opposing the magnetic pole N1, the developer height is formed by N1 having the most intensive magnetic force and S1, S2 and the electrostatic latent image is developed by the toner. The developer used for development is returned to the developing tank 11 by the sleeve roller 12 and separated therefrom at the non-magnetized position between N2 and N3.

While at non-developing (refer to the first developing device 4 in FIG. 3), the intermediate portion between the magnetic poles S1 and N1 opposes the photosensitive drum 1 (solenoid 33 is ON). The sleeve roller 12 is at a standstill (motor 24 is OFF).

The case where the electrostatic latent image formed by one exposure scanning is copied in two colors (simultaneous-color copying) by using the developing devices 4, 5 in the copying apparatus described above will be roughly explained as follows.

First, as shown in FIG. 2, in the present embodiment, it is constructed as such that by sliding the first and second levers 35, 36 disposed in the vicinity of the original glass 44 in the arrow directions, the areas where the black-and-white and/or color copyings should be performed and designated. Here, on the original 45, the black-and-white copying is effected between the front end of the original and the first lever 35, the color copying between the first lever 35 and the second lever 36, and again the black-and-white copying between the second lever 36 and the rear end of the original.

In the initial state, the first developing device 4 is, as shown in FIG. 3, opposing the photosensitive drum 1 at the intermediate portion between the magnetic poles N1 and S2. In the second developing device 5, the magnetic pole N1 opposes the photosensitive drum 1. That is, in the initial state, the state for development is kept by the second developing device 5.

Figure 7:
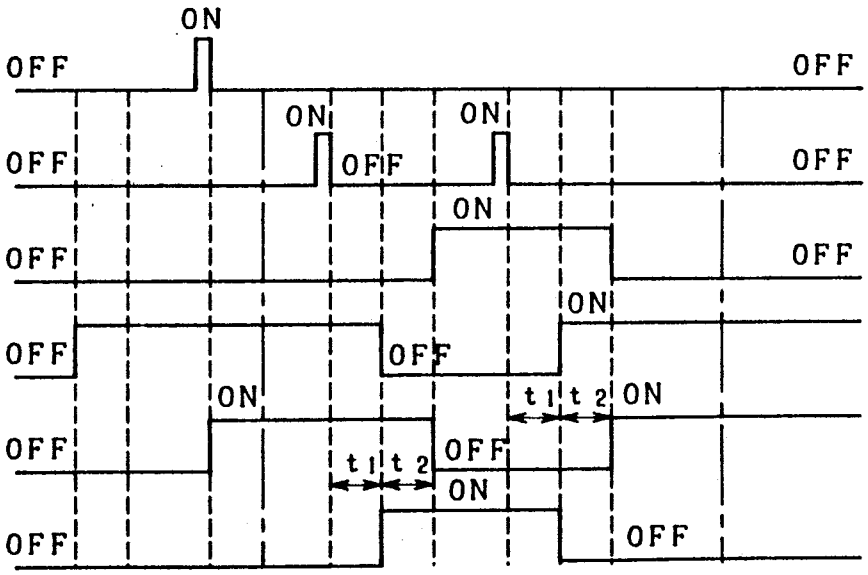
FIG. 7 is a time chart showing operations of developing devices and a reed switch at simultaneous-color copying.

FIG. 7 is a time chart showing operations of the developing devices and reed switch 39 at simultaneous-color copying.

In the aforesaid initial state, the development is first effected by the second developing device 5 when a print key 101 is ON.

Next, when the scanning unit 112 moves leftward to the first lever 35, the reed switch 39 is switched ON by the magnet 37. At this point of time, the latent image responsive to the border from black to color is at W position on the photosensitive drum 1 shown in FIG. 3.

During the time $t_1$ in which the latent image moves from W to the developing area X of the first developing device 4, only the second developing device 5 is operated continuously. When the latent image has arrived at X, the first developing device motor 24 is ON and the first developing device solenoid 33 is OFF to oppose the magnetic pole N1 to the photosensitive drum 1 for starting the color development.

Furthermore, after the time $t_2$ during which said latent image moves from X to development area X' of the second developing device 5, the second developing device motor 24' is OFF and the second developing device solenoid 33' is ON to oppose the intermediate portion between the magnetic poles N1 and S2 to the photosensitive drum 1 for completing the black development. Switching from black to color is thus completed.

Next, when the scanning unit 112 is moved further to the second lever 36, the reed switch 39 is switched ON again by the magnet 38.

After the time $t_1$ since the reed switch 39 has been ON, conversely to the preceding case, the first developing device motor 24 is OFF and first developing device solenoid 33 is ON to complete the color development. Further, after the time $t_2$, the second developing device motor 24' is ON and the second developing device solenoid 33' is OFF to start the black development. Until the completion of electrostatic latent image development, only the second development device 5 is operated.

By the operations described heretofore, during the development of electrostatic latent image formed by one exposure scanning, the first and second developing devices 4, 5 are switched to change over the developing toner color from black to color and color to black.

It will be appreciated that two or more switchings (black→color→black→color→black . . . ) during the development as well as installing three or more developing devices are also possible.

Figure 8:
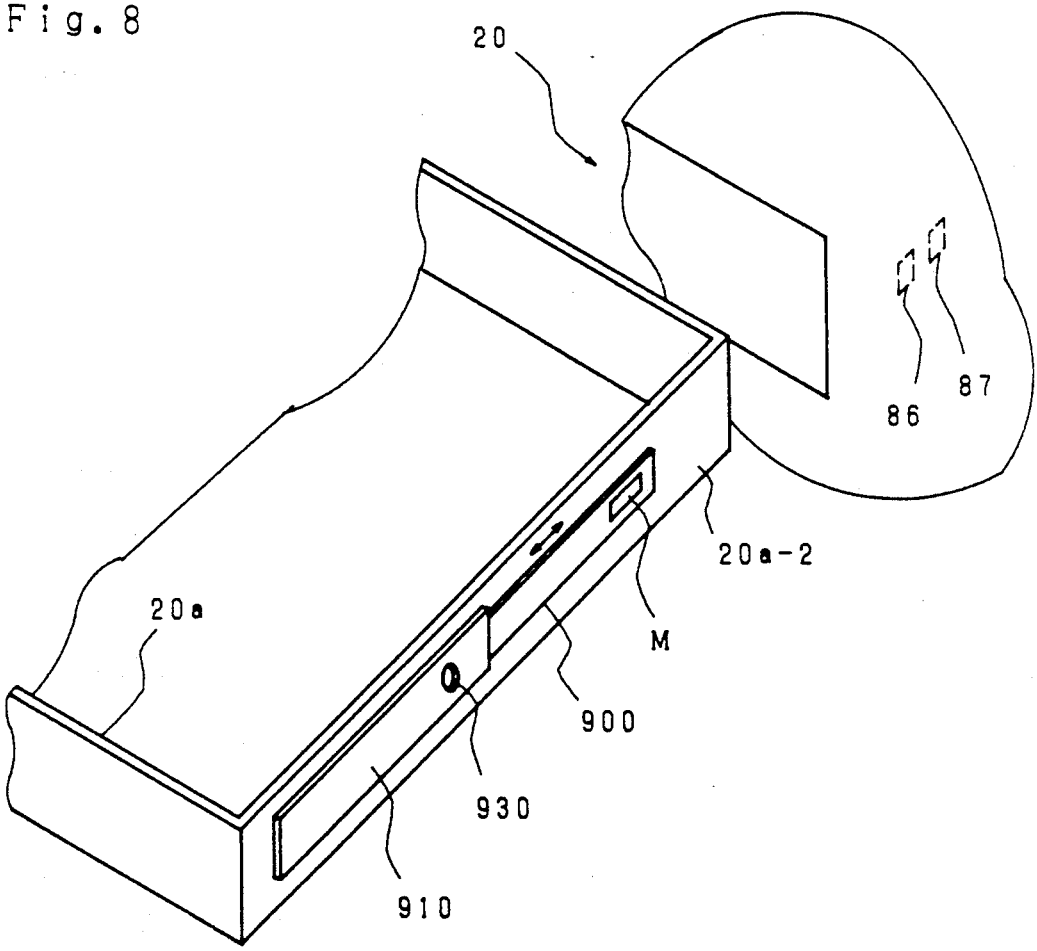
FIGS. 8 and 9 are perspective views illustrating a color discriminating mechanism of a first paper feeder.
Figure 9:
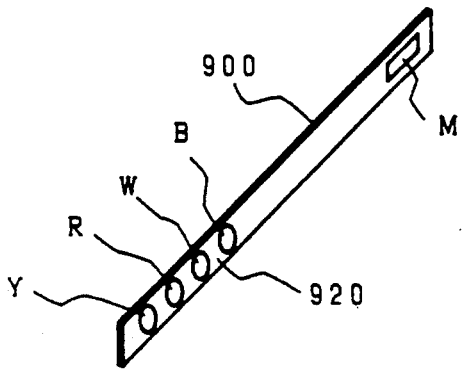

As shown in FIGS. 8 and 9, color discriminating sensors of the copying paper mounted are situated in the first and second paper feeders. Now, the first paper feeder 20 will be explained by an example.

In the first paper feeder 20, on the side of the copying machine body near the side end of the mounting position of a cassette 20*a*, reed switches 86, 87 for outputting the color signal are located in parallel to the cassette side face (20*a*-2), whereon a moving member 900 held by a holding member 910 and movable in its lateral direction is situated.

On one end of the moving member 900, as shown in FIG. 9, a magnet M is situated for switching the reed switches 86, 87 ON and OFF. On the other end of the moving member 900, a color displays 920 responsive to the color of copying paper contained in the cassette 20*a* are installed and colored, for example, in order of red(R), white(W), yellow(Y) and blue(B). Responsive to the color displays 920, a color recognizing window 930 is formed on the holding member 910. According to the position of magnet M, a corresponding reed switch is ON, and combination of ON and OFF of the two reed switches 86, 87 makes it possible to discriminate $2^2=4$ colors. That is, the color of copying paper is discriminated by coded signals such as white(00), red(01), yellow(10) and blue(11).

The second paper feeder 22 also includes the same color discriminating sensor as above and the switches 88, 89.

In the present embodiment, though the copying paper discriminating sensor is installed with a discriminating indicator (magnetic or optical as above) on every cassette to discriminate the color paper by reading it, a color sensor of CCD or the like may be installed on copying machine on the paper feed cassette or in the paper passage of the copying machine to directly discriminate the paper color thereby.

Now, also in the first and second developing devices 4, 5, the toner color is discriminated according to the same construction as the paper feeder in such a manner that, the toner color is discriminated by the coded signal by reed switches 90, 91 in the former and by reed switches 92, 93 in the latter. As the toner color discriminating device, other magnetic or optical displaying and reading methods may be utilized.

Figure 10:
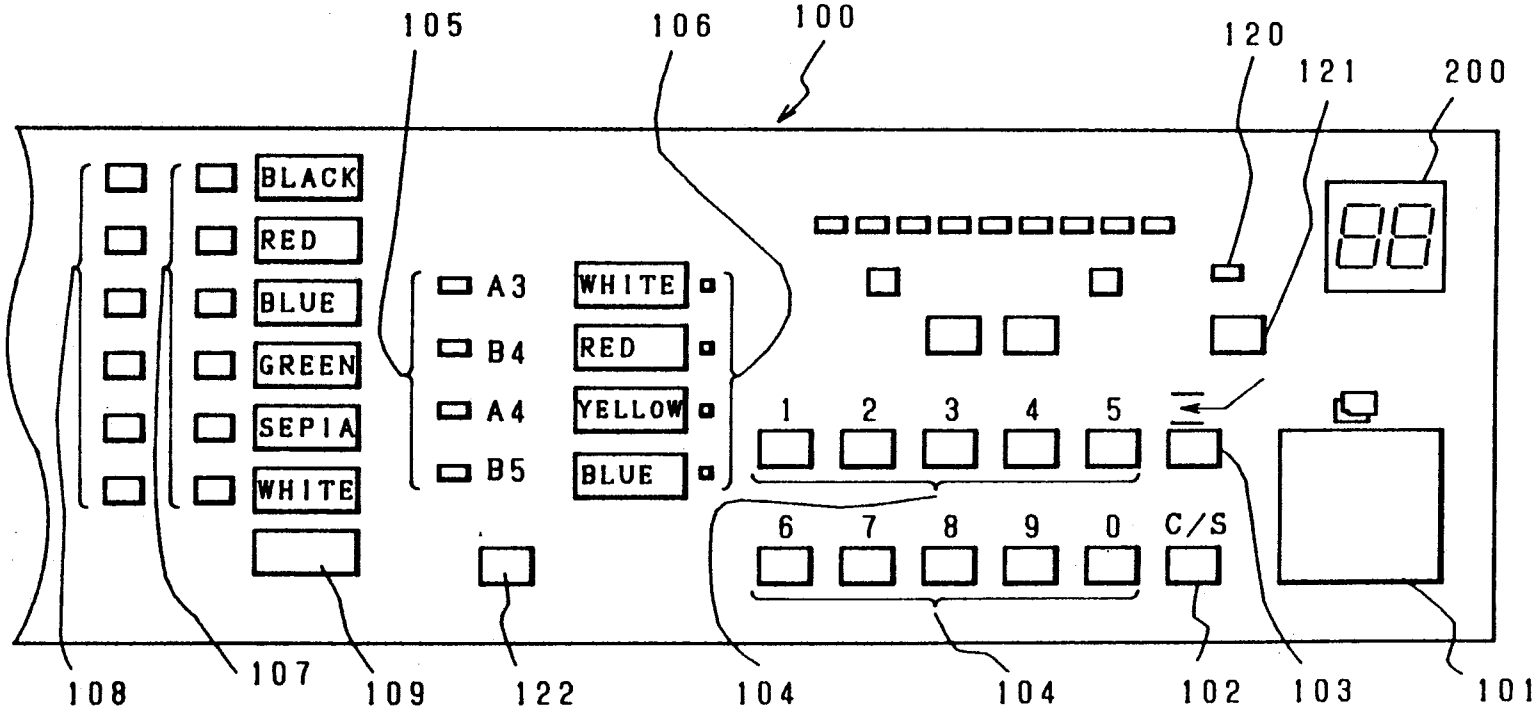
FIG. 10 is an enlarged plan view showing a portion of an operating panel.

FIG. 10 is a plan view showing a portion of the operating panel 100 of the copying machine.

On the operating panel 100, there are disposed in order from the right lower portion, a print key 101, a clear/stop key 102, an interrupting key 103, the-key group 104, selected paper cassette size display 105, selected paper color display 106, paper selecting key 122, toner color display 107 of the first developing device mounted, toner color display 108 of the second developing device mounted, developing device selecting key 109 at developing in monochrome, numerical display 200, simultaneous-color copying mode selecting key 121 and simultaneous-color copying mode display LED 120, etc.

Figure 11:
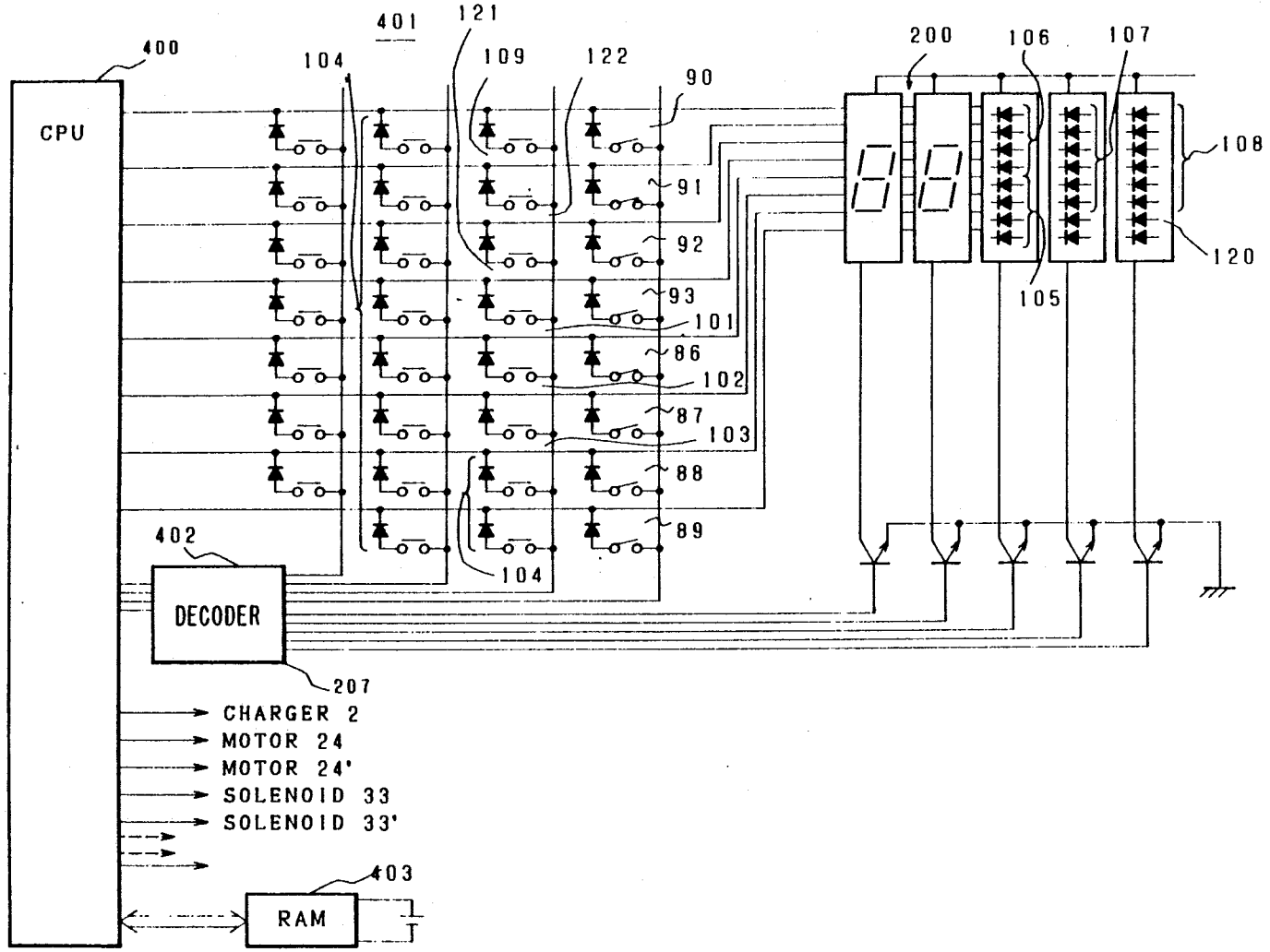
FIG. 11 is an input-output construction view showing a control circuit for controlling a copying machine of the present embodiment.

FIG. 11 is a construction view showing the input-output configuration of a control circuit of the copying machine.

The control circuit is constituted mainly by a CPU 400, to which, through a decoder 402, a key group on the operating panel, color detecting reed switches 86~89 of the copying paper, toner color detecting reed switches 90~93 of the developing devices, lever position detecting reed switch 39, switch matrix 401 in which various switches and sensors in the copying machine are arranged in all directions, and moreover, numerical display 200 and LED display group on the operating panel 100 are connected.

The CPU 400 outputs the drive control signal to image forming elements such as the charger 2, etc. and it also outputs the drive signal to the developing device driving motors 24, 24', solenoid 33, 33' and so on to control the image forming operation. The CPU 400 is also connected to a RAM 403 backed up by a battery.

Figure 12:
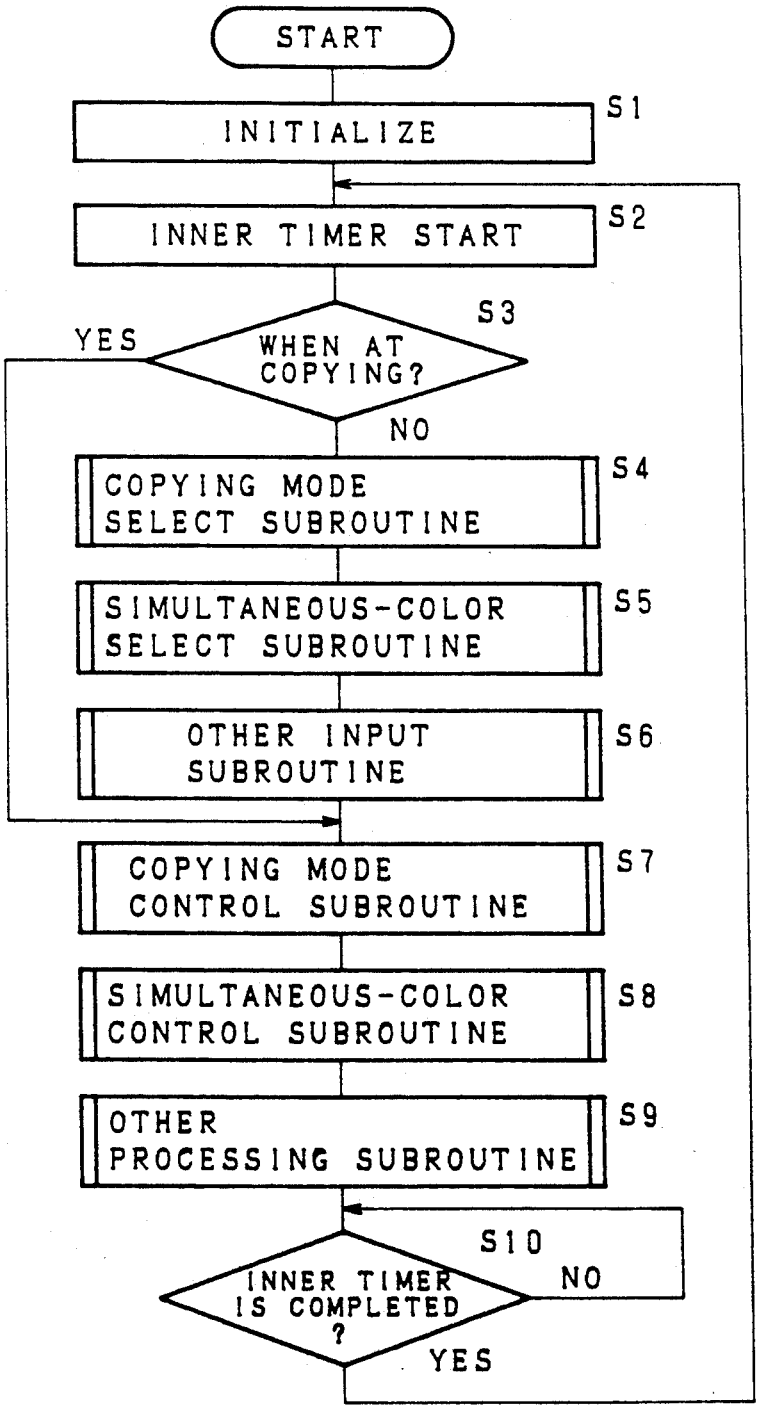
FIG. 12 is a flow chart showing a main routine of a CPU.

FIG. 12 is a flow chart showing a main routine of the CPU 400. Before explaining the flow chart, the terms "on-edge" and "off-edge" will be defined.

On-edge is defined as a variation of state where the states of a switch, sensor, signal etc. have changed from OFF to ON.

While, off-edge is defined as a variation of state where the states of a switch, sensor, signal etc. have changed from ON to OFF.

First, an initial state is set by switching on a power supply and so on (S1). That is, various registers, flags etc. in the CPU 400 are brought to the initial state and data stored in the RAM 403 are cleared if necessary.

Next, an inner timer for regulating the time of one routine is started (S2), and when it is not at copying, a copying mode select subroutine (S4), simultaneous-color select subroutine (S5) and other input subroutine (S6) are executed in order. When at copying, the aforesaid S4–S6 are skipped and a copying mode control subroutine (S7), simultaneous-color control subroutine (S8) and other processing subroutine (S9) are executed. Thereafter, the procedure returns to S2 after the completion of inner timer started in S2.

Figure 13:
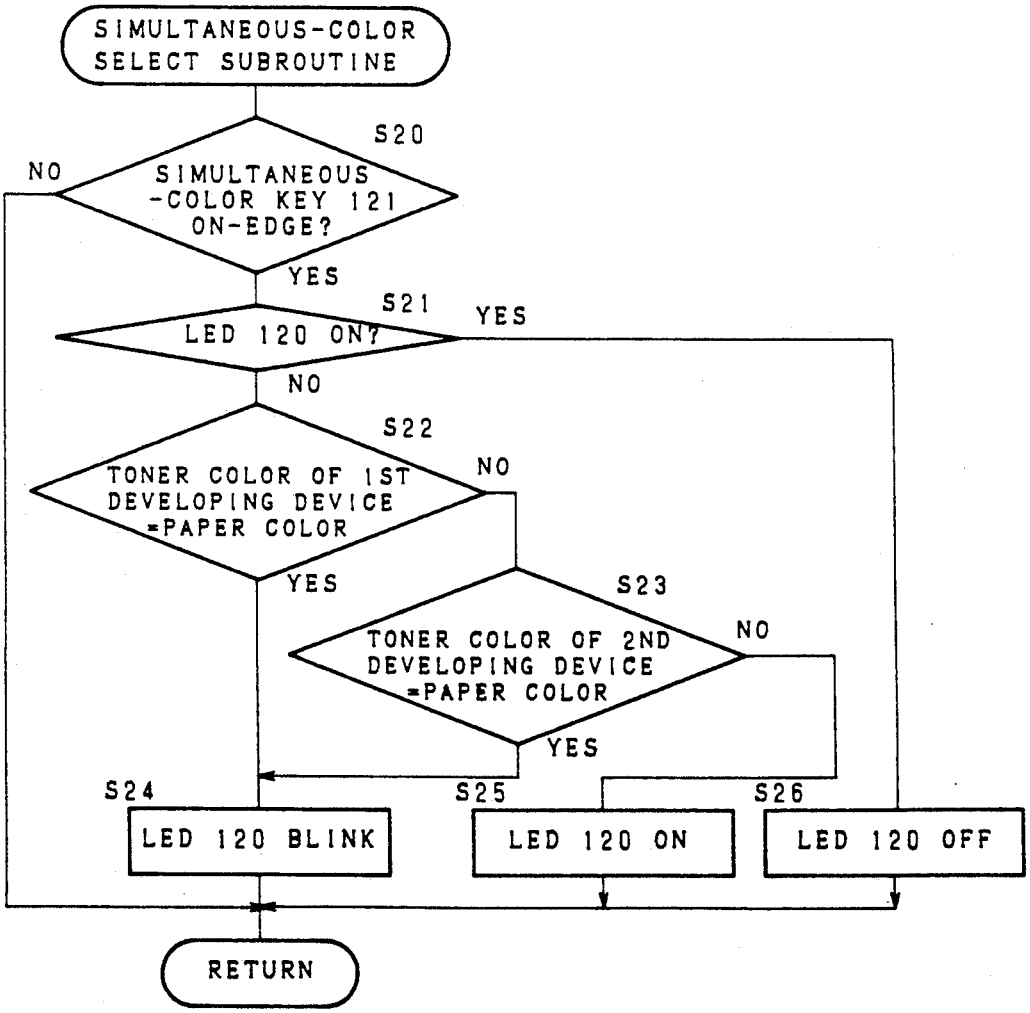
FIG. 13 is a flow chart showing the detail of simultaneous-color selecting routine of a CPU.

FIG. 13 is a flow chart particularly showing the simultaneous-color select subroutine (S5). The simultaneous-color control subroutine in S8 is for controlling the simultaneous-color copying. Explanations on the other routines will be omitted.

As shown in FIG. 13, it is determined whether the on-edge of simultaneous-color copying mode selecting key 121 is present or not (S20), and in the on-edge, it is determined whether the simultaneous-color copying mode display LED 120 is lit (S21).

When the simultaneous-color copying mode display LED 120 is lit, it is determined whether the toner color of the first developing device 4 and the paper color to be fed is the same or not (S22). That is, it is determined whether the color codes of the first developing device 4 and the selected paper feed cassette are identical or not. If not, simultaneously, it is determined whether the toner color of the second developing device and the paper color to be fed are identical or not (S23). In S22 and S23, when the toner color and paper color are aligned, the simultaneous-color copying mode display LED 120 is blinked to warn display (S24).

While, in S23, when the toner color of the developing device and the paper color in the selected paper feed cassette are not identical, the simultaneous-color copying mode display LED 120 is lit (S24).

When the simultaneous-color copying mode display LED 120 is lit in the on-edge of the simultaneous-color copying mode selecting key 121, the display LED is put out (S26).

In the aforesaid embodiment, when the toner color and the paper color are identical, only the warning display is given (S25). However, the development may be performed only by the developing device having the toner color different from the paper color to be fed by canceling the simultaneous-color copying mode.

In the copying machine described hereinabove, it is also possible to develop the electrostatic latent image by using only one of the two developing devices installed. In this case, the warning display is given also when the toner color of the developing device used coinsides with the paper color to be fed.

Now, the second embodiment of the present invention will be explained.

Figure 14:
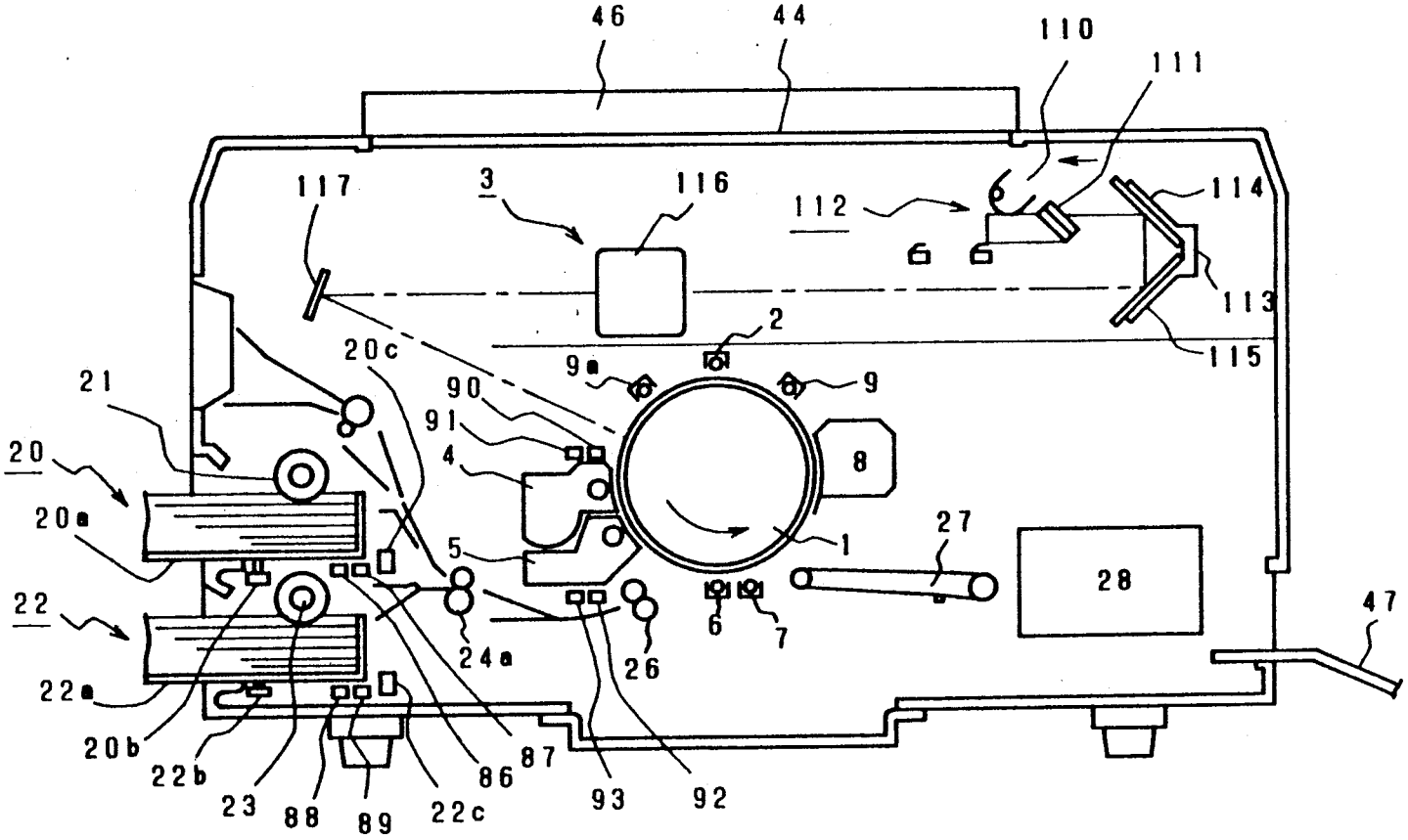
FIG. 14 is a schematic sectional view showing the construction of a copying machine of a second embodiment of the present invention.
Figure 15:
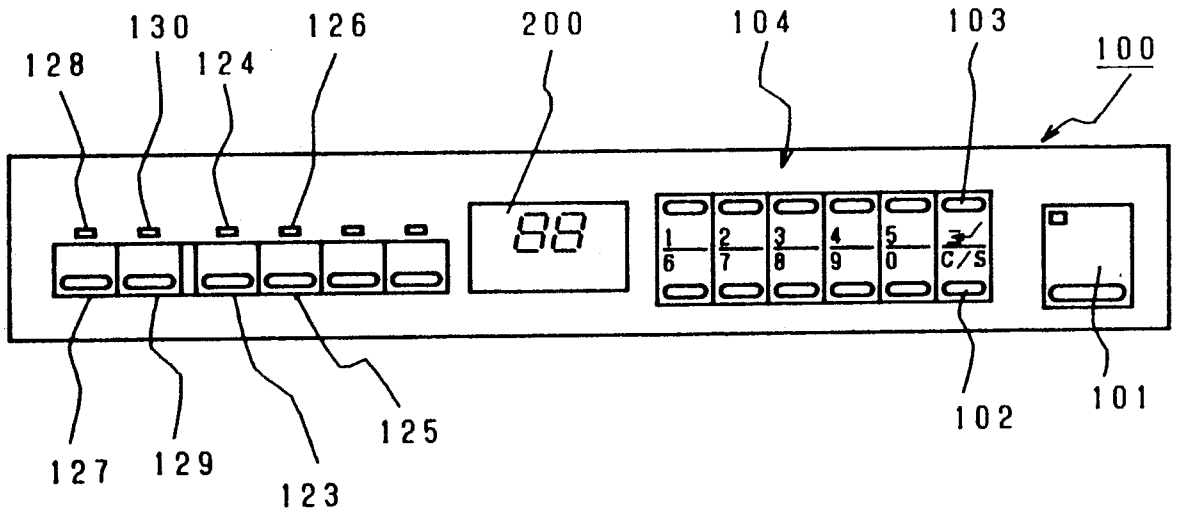
FIG. 15 is a plan view showing the construction of an operating panel of a copying machine of the second embodiment.

FIG. 14 is a schematic sectional view showing the construction of a copying machine, and FIG. 15 is a schematic front view showing the construction of its operating panel.

As shown in FIG. 14, approximately in the center of the copying machine, there is pivoted a photosensitive drum 1, which is surrounded by peripheral equipments composed of a charger 2, inter-image eraser 9*a*, first and second developing devices 4, 5, transfer charger 6, separation charger 7, cleaning device 8 and eraser lamp 9 arranged along its rotational direction in spaced relation. On the left hand side of the photosensitive drum 1, the equipments which constitute a paper feed system for feeding copying paper are disposed, while on the right hand side thereof, a fixing device 28 is arranged. In addition, above these equipments, the equipments which constitute an optical system 3 to be described later are arranged.

The paper feed system which is substantially the same construction as the first embodiment includes a first paper feeder 20 (upper side in the figure) and a second paper feeder 22, which are respectively mounted with a first paper feed cassette 20*a* and second paper feed cassette 22*a* wherein the prescribed copying paper is contained. The copying paper fed from the first or second paper feed cassette 20*a*, 22*a* is conveyed respectively to a timing roller 26 from a first paper feed roller 21 or second paper feed roller 23 through an intermediate roller 24*a*.

In the vicinity of these paper feeders 20, 22, copying paper color discriminating sensors for discriminating the copying paper color contained in the paper feed cassettes 20*a*, 22*a*, size discriminating sensors 20*c*, 22*c* for detecting their size, and further empty sensors 20*b*, 22*b* for detecting the emptiness of copying paper are disposed. Each copying paper color discriminating sensor is as same as those illustrated in the first embodiment, and constituted by a magnet M and reed switches 86, 87 or 88, 89 provided on each paper feed cassette 20*a*, 22*a* to discriminate and detect the color of copying paper contained in the paper feed cassettes 20, 22 by combination of ON and OFF of each reed switch 86, 87 or 88, 89. That is, the colors of copying paper thus detected may be represented as shown in the following Table 1 if, for example, the copying paper color discriminating sensor are respectively constituted by the reed switches 86, 87.

TABLE 1

| Reed Switch 86 | Reed Switch 87 | Copying Paper Color |
|---|---|---|
| OFF | OFF | White |
| OFF | ON | Black |
| ON | OFF | Red |
| ON | ON | Blue |

While, the optical system 3 is constituted by a scanning unit 112 in which a light source 110 and a first movable mirror 111 are integrated in one unit, second and third movable mirrors 114, 115 held by a common holder 113, lens 116 and stationary mirror 117.

By moving the scanning unit 112 leftward in the figure from its standby position to scan the original, an electrostatic latent image responsive to an original image is formed on the surface of photosensitive drum 1.

The electrostatic latent image formed on the surface of photosensitive drum 1 is developed by adhesion of a negative polar toner supplied from one of the selected developing devices 4, 5 to from a toner image on the surface of photosensitive drum 1.

The toner image is transferred on the copying paper supplied from the timing roller 26 by the transfer charger 6.

The copying paper whereon the image is transferred is separated from the surface of photosensitive drum 1 by the separation charger 7, conveyed by the conveying belt 27 to the fixing device 28, thereby the toner image is heated and fixed and discharged on the discharge tray 47.

Near the developing devices 4, 5, as same as the first embodiment, a toner color discriminating sensor comprising the magnet and the reed switches 90, 91 or 92, 93 is disposed on each developing device 4, 5, so as to discriminate and detect the color of toner contained respectively in the developing devices 4, 5 by combination of ON and OFF of the reed switches 90, 91 or 92, 93. That is, the toner colors thus detected may be represented as shown in the following Table 2 if, for example, the toner color discriminating sensor is respectively constituted by the reed switches 90, 91.

TABLE 2

| Reed Switch 90 | Reed Switch 91 | Toner Color |
|---|---|---|
| OFF | OFF | White |
| OFF | ON | Black |
| ON | OFF | Red |
| ON | ON | Blue |

As shown in FIG. 15, an operating panel 100 is located on the copying machine. On the operating panel, a print key 101, interrupting key 103, numerical display 200, clear/stop key 102, ten-key group 104 for setting the number of copying paper, first paper feeder selecting key 123 and LED 124 which respectively selects and displays the copying paper fed from the first paper feed cassette 20*a* mounted on the first paper feeder 20, second paper feeder selecting key 125 and LED 126 which respectively selects and displays the copying paper fed from the second paper feed cassette 22*a* of the second paper feeder 22, first developing device selecting key 127 and LED 128 which respectively selects and displays the first developing device 4 as a serviceable developing device, second developing device selecting key 129 and LED 130 which respectively selects and displays the second developing device 5, and further, for example, an exposure-up key, exposure-down key and LED group which display prescribed information (all not shown here) are disposed.

Figure 16:
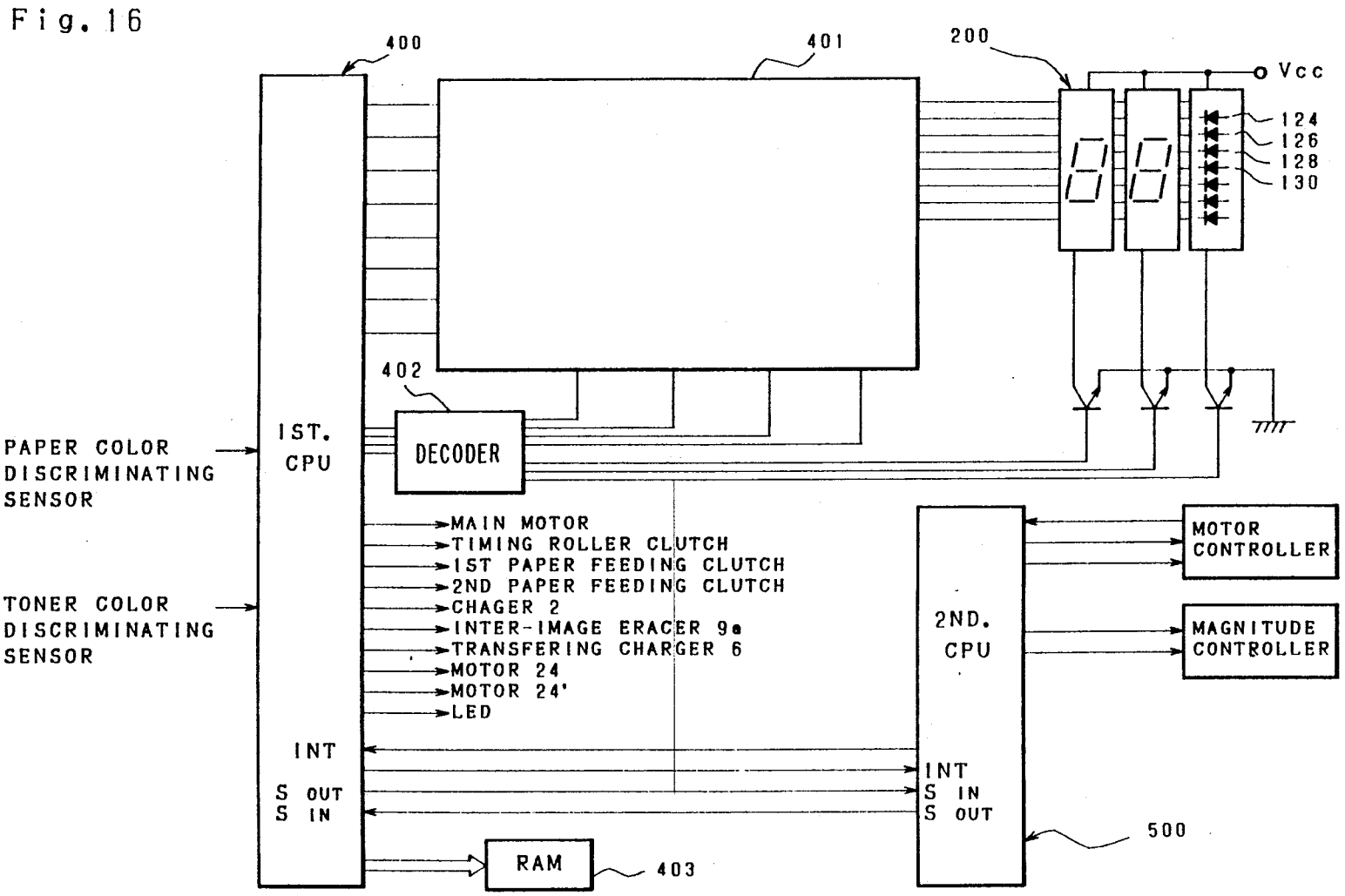
FIG. 16 is an input-output circuit construction view of two CPUs incorporated in a copying machine of the second embodiment.

Additionally, in the copying machine, a microcomputer having an input-output circuit configuration as shown in FIG. 16 and provided with first and second CPUs 400, 500 is incorporated. To the first CPU 400, a switch matrix 401 in which various keys, switches and sensors on the operation panel are arranged in all directions is connected, whereby the main motor, rollers and clutches, etc. are operated and controlled in response to operations of the key and sensor as well as each LED of the numerical display 200 is ON or OFF through the decoder 402. To the first CPU 400, the copying paper color detecting signal is inputted from the copying paper color discriminating sensor, and the color detecting signal of the toner contained in the developing devices 4, 5 from the toner color discriminating sensor so as to be compared with each other. The numeral 403 in the figure denotes a RAM as a memory connected to the first CPU 400 and backed up by a battery (not shown here).

Meanwhile, to the second CPU 500, switches associated with the operation of scanning unit 112 and so on are connected. The second CPU 500 is designed to operate and control mainly the optical system 3. The first and second CPUs 400, 500 are interconnected through bus lines and designed to operate in synchronism.

Next, the operation and control of first CPU 400 constituting the microcomputer will be explained on the basis of flow charts shown in FIG. 17 through FIG. 19.

Figure 17:
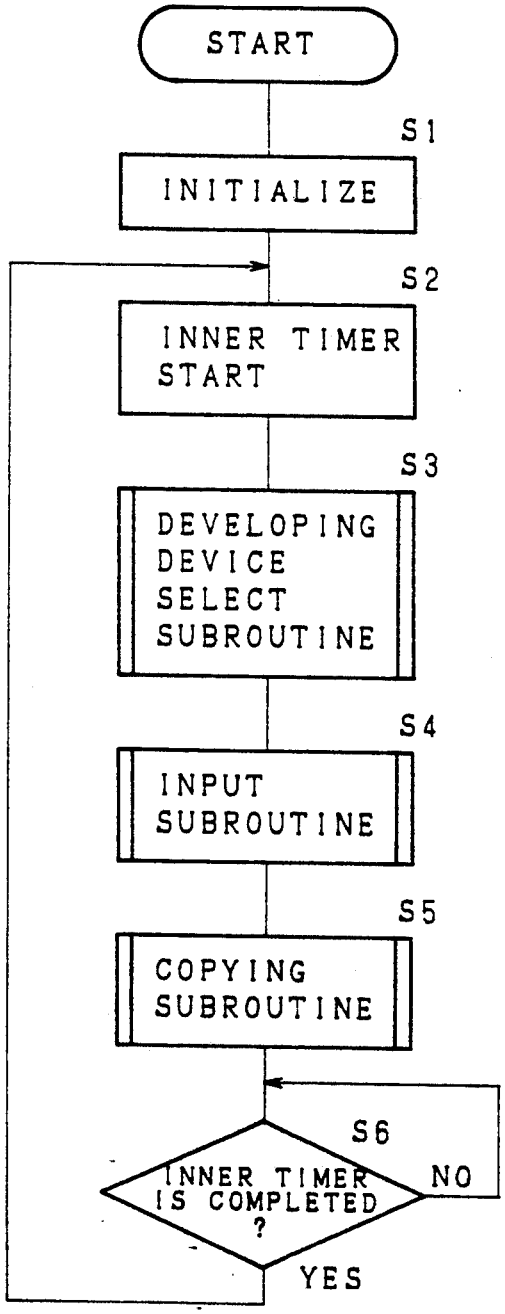
FIG. 17 is a flow chart showing a main routine of a first CPU of the second embodiment.

FIG. 17 is a flow chart showing a main routine of a program for controlling the operation of copying machine of the second embodiment. First, a flow of the program will be explained on the basis of the main routine.

(1) When a power source is put on and the program is started, in Step S1, the first and second CPUs 400, 500 are initialized and, at the same time, the initial setting is performed to set all equipment in the initial state.

(2) Then, in Step S2, an inner timer set in the initial setting is started. The inner timer is for setting the processing time of one whole routine constant independently of processing contents in each following subroutine, and various timers of each subroutine are set on the standard unit of setting time of this one routine.

(3) Successively, in Step S3, a developing device selecting subroutine to be described later is called and executed, whereby in response to the color of copying paper contained in the paper feed cassette selected, the developing device containing the toner of different color from the above is selected and displayed. In this case, the developing device containing the toner color in a complementary color relation with the copying paper color or in a close complementary color relation with it is selected first. When the developing device containing the toner of different color from the copying paper color is not mounted but only the developing device containing the toner of same color as the copying paper color is mounted on the copying machine, this will be displayed.

(4) Next, in Step S4, an input subroutine to be described later is called and executed, whereby the color of copying paper contained in the paper feed cassette selected by the key input from the operating panel is discriminated and detected.

(5) Successively, in Step S5, a copying operation subroutine is called and executed. general processing contents in the copying operation subroutine are well known so that its explanation will be omitted.

(6) Finally, in Step S6, it is determined whether the inner timer is completed or not, and when it is completed, the procedure returns to Step S1.

Now, a flow of the program will be explained on the basis of the flow chart showing each subroutine. In the following subroutines, the present invention is applied to the case to be explained where the color of copying paper contained in the paper feed cassette selected is "black" and "1" is set in a "black" paper flag. However, the present invention is not applied restrictively only to such a case, it will be appreciated that it is also applicable, as same as the present embodiment, to the case where the copying paper color is other than "black". The explanation thereof will be omitted.

DEVELOPING DEVICE SELECT SUBROUTINE

Figure 18:
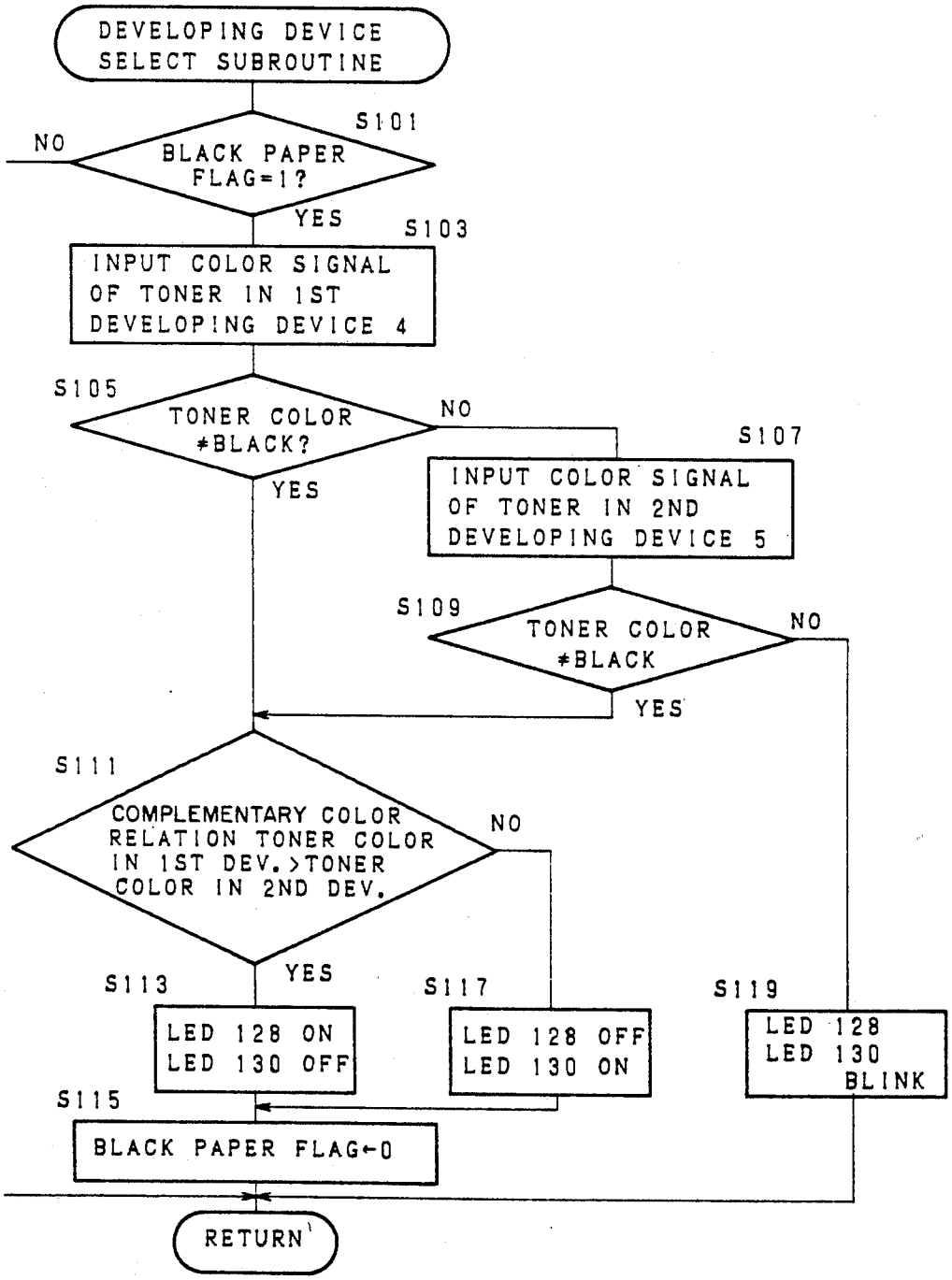
FIG. 18 is a flow chart showing a developing device selecting subroutine of the second embodiment, FIGS. 19 (A) and (B) are flow charts showing an input subroutine of the second embodiment.

FIG. 18 shows a flow chart of a developing device select subroutine.

(1) In S101, it is determined whether "1" is set in the "black" paper flag, and if it is or the color of copying paper contained in the paper feed cassette selected is "black", after the color signal of the toner contained in the first developing device 4 detected by combination of the opening and closing state of the reed switches 90, 91 of the toner color discriminating sensor is inputted in the next S103, the procedure moves to S105. In S105, it is determined whether the toner color inputted is other than "black" such as "white", "red" or "blue", if it is, the procedure moves to S111. When it is determined in S101 that "1" is not set in the "black" paper flag, or the "black" copying paper is not selected, the procedure returns to the main routine skipping S103, S105 and S107–S119 to be explained later.

(2) When it is determined in S105 that the toner color in the first developing device 4 is not other than "black" or it is "black", the procedure moves to S107. After the color signal of the toner contained in the second developing device 5 detected by the toner color discriminating sensor is inputted in S107, it is determined whether the toner color inputted in S109 is other than "black" or not as same as the preceding processing, and if it is, the procedure moves to S111.

(3) In S111, it is determined which color of the toners contained in the first and second developing devices 4, 5 is in more intensive complementary color relation or in close complementary color relation relative to the color of copying paper "black". When it is determined that the complementary color relation of the toner color in the first developing device 4 is stronger than that of the toner color in the second developing device 5 such as the case that, for example, the toner color in the first developing device 4 is "white" and that in the second developing device 5 is "red", the first developing device 4 is selected in S113. Then, the LED 128 is ON to display that the first developing device 4 was selected in S113, and, at the same time, the LED 130 displaying that the second developing device 5 is selected is OFF, then the procedure returns to the main routine after resetting the "black" paper flag at "0" in S115.

The complementary color relation and its strength between the copying paper color and toner color are, for example, in the relationship shown in the following Table 3. In the Table 3, the larger the numerical value indicates the stronger the complementary color relation. Here, the complementary color means not necessarily the complementary color of a hue, but a most conspicuous color relative to the copying paper to be used. Accordingly, a selective order of the toner color relative to the copying paper color can be suitably set not only by its hue but also by a color density.

TABLE 3

| Copying Paper Color | Toner Color | | | |
|---|---|---|---|---|
| | White | Black | Red | Blue |
| White | | 3 | 3 | 3 |
| Black | 3 | | 1 | 1 |
| Red | 2 | 1 | | 2 |
| Blue | 1 | 2 | 2 | |

(4) When it is determined in S111 that the complementary color relation of the toner color in the second deverloping device 5 is stronger than the toner color in the first developing device 4 relative to the "black" color of copying paper, the second developing device 5 is selected in S117, the LED 130 is ON to display it and, at the same time, the LED 128 displaying that the first developing device 4 is selected is OFF, then after resetting the "black" paper flag at "0" in S115, the procedure returns to the main routine.

(5) Furthermore, when it is determined in aforesaid S109 that the toner color in the second developing device 5 is not other than "black", or it is "black", in both the first and second developing devices 4, 5, the toner other than the "black" color is not contained, thus the "black" toner is contained in the both. Then, in next S119, the LEDs 128 and 130 for the developing device selecting display are blinked to warn that, the "black" toner is contained in both the first and second developing devices 4, 5 and miscopying may occur. Thereafter, the procedure returns to the main routine.

INPUT SUBROUTINE

Figure 19:
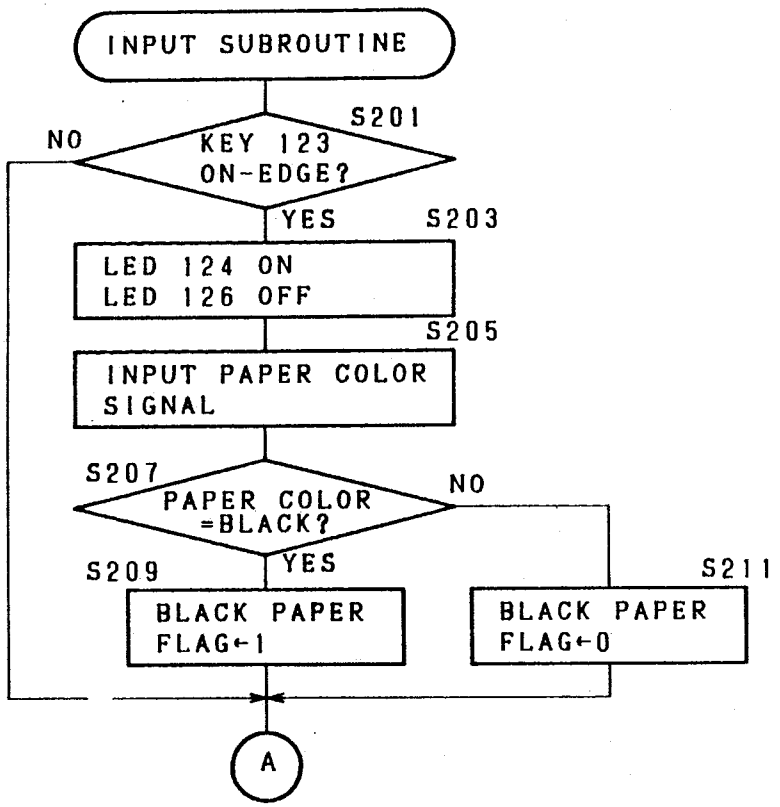
Figure 19:
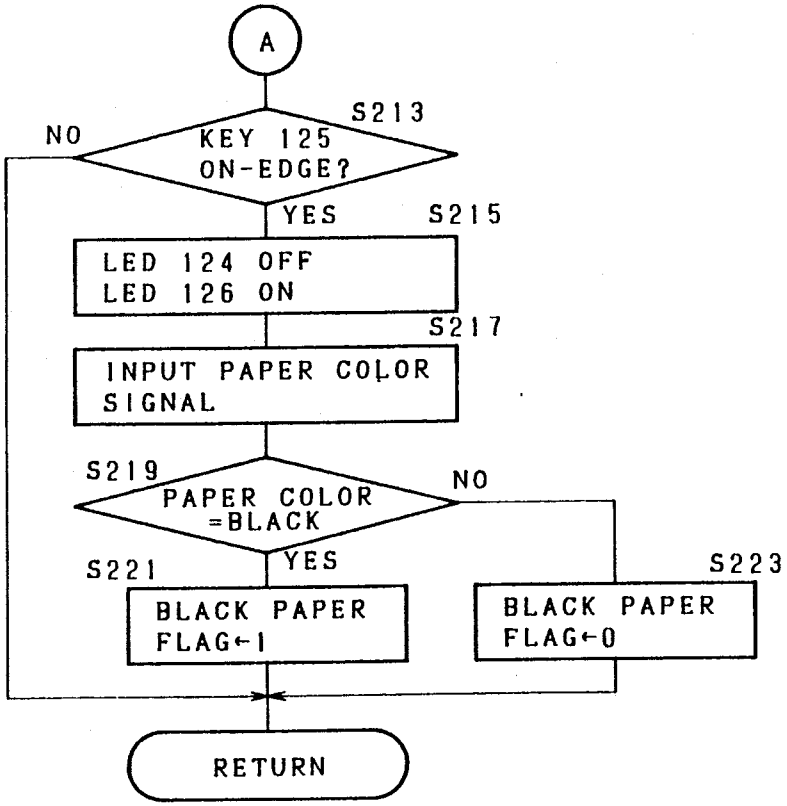

Flow charts of an input subroutine are shown in FIGS. 19 (A) and (B).

(1) In S201, it is determined whether the first paper feeder selecting key 123 is pressed or not, if it is, in S203, then the LED 124 displaying that the copying paper is fed from the first paper feed cassette 20*a* is ON and, at the same time, the LED 126 displaying that the second paper feeder 22 is selected is OFF. Then, the procedure moves to S207 after the color signal of the copying paper detected by the copying paper color discriminating sensor is inputted in S205.

(2) In S207, it is determined the color signal inputted or the color of copying paper contained in the first paper feed cassette 20*a* selected is "black" or not, if it is, then the procedure moves to S213 after setting "1" in the "black" paper flag in S209. When it is determined in S207 that the copying paper color is other than "black", the procedure moves to S213 after setting "0" in the "black" paper flag in S211. Though not shown here, when the color signal of copying paper inputted in S207 is other than "black", in these S207–S211, processings responsive to respective color signals are performed. For example, when it is determined in S207 that the input signal is "white" or the copying paper color is "white", the procedure moves to S213 after setting "1" in the "white" paper flag in S209. When the first paper feeder selecting key 123 is not pressed in S201, the procedure moves to S213 skipping S203–S211.

(3) In S213, it is determined whether the second paper feeder selecting key 125 or not is determined, if it is, in S215, then the LED 126 displaying that the copying paper is fed from the second paper feed cassette 22*a* is ON, and, at the same time, the LED 124 displaying that the first paper feeder 20 is selected is OFF. Then, the procedure moves to S219 after the color signal of copying paper detected by the copying paper color discriminating sensor is inputted in S217.

(4) In S219, it is determined whether the color signal inputted is "black" or not, if it is, then the procedure returns to the main routine after setting "1" in the "black" paper flag in S221. When it is determined in S221 that the copying paper color is other than "black", the procedure returns to the main routine after setting "0" in the "black" paper flag in S223. Though not shown here, when the color signal of copying paper inputted in S217 is other than "black", as same as aforementioned, the procedure returns to the main routine after processings responsive to respective color signals of copying paper inputted have been performed. When the second paper feeder selecting key 125 is not pressed in S213, the procedure returns to the main routine skipping S215–S223.

In the aforesaid explanation, though the present invention has been applied to the copying machine including two developing devices 4, 5 and paper feeders 20, 22, it will be appreciated that the present invention is not limited to such a construction, it may also be applicable even one paper feeder or three or more paper feeders and developing devices are installed.

Now, the third embodiment of the present invention will be explained. Since the construction and control circuit of the third embodiment are same as FIG. 14 through FIG. 16 of the second embodiment, their explanation will be omitted.

Figure 20:
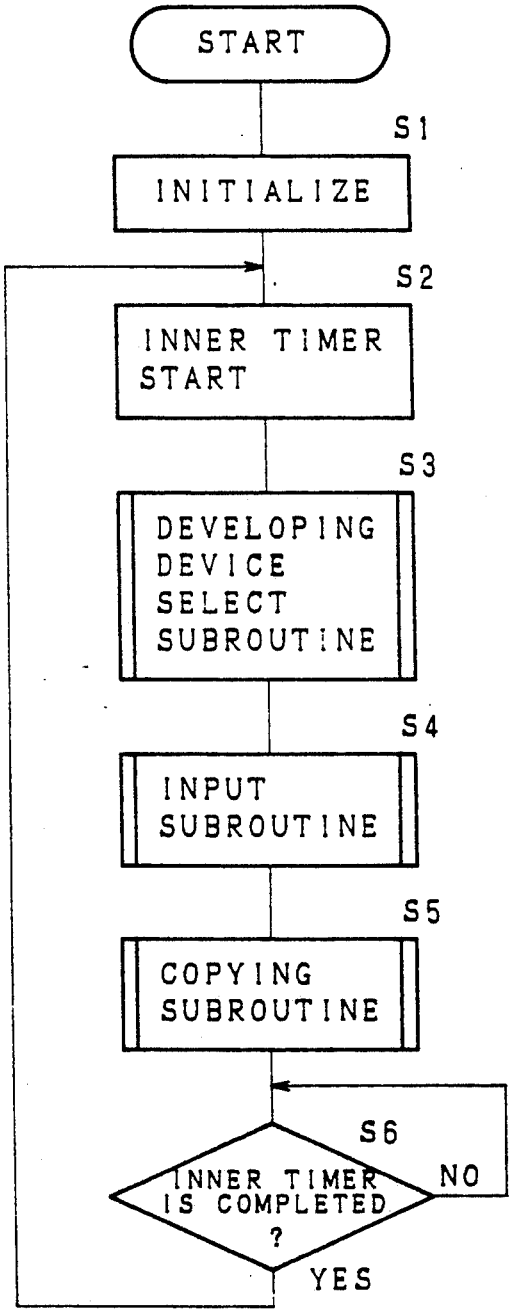
FIG. 20 is a flow chart showing a main routine of a first CPU of a third embodiment.

FIG. 20 is a flow chart showing a main routine of a program for controlling the operation of copying machine of the third embodiment. First, a flow of the program will be explained on the basis of the main routine.

(1) When a power source is put on and the program is started, in step S1, the first and second CPUs 400, 500 are initialized and, at the same time, the initial setting is performed to set all equipments in the initial mode.

(2) Next, in Step S2, inner timer set in the initial setting is started. The inner timer is for setting the processing time of one whole routine constant independently of processing contents in each following subroutine, and various timers of each subroutine are set on the standard unit of setting time of this one routine.

(3) Successively, in Step S3, a developing device select subroutine to be described later is called and executed, whereby in response to the color of copying paper contained in the paper feed cassette selected, the developing device containing the toner of different color from the above is selected. At this time, when the developing device containing the toner of different color from the copying paper color is not mounted, but only the developing device containing the toner of same color as the copying paper color is mounted on the copying machine, this will be displayed.

(4) Next, in Step S4, an input subroutine to be described later is called and executed, whereby the color of copying paper contained in the paper feed cassette selected by the key input from the operating panel is discriminated and detected.

(5) Successively, in Step S5, a copying operation subroutine is called and executed. General processing contents in the copying operation subroutine are well known so that its explanation will be omitted.

(6) Finally, in Step S6, it is determined whether the inner timer is completed or not, and when it is completed, the procedure returns to Step S1.

Now, a flow of program will be explained on the basis of the flow chart showing each subroutine.

DEVELOPING DEVICE SELECT SUBROUTINE

Figure 21:
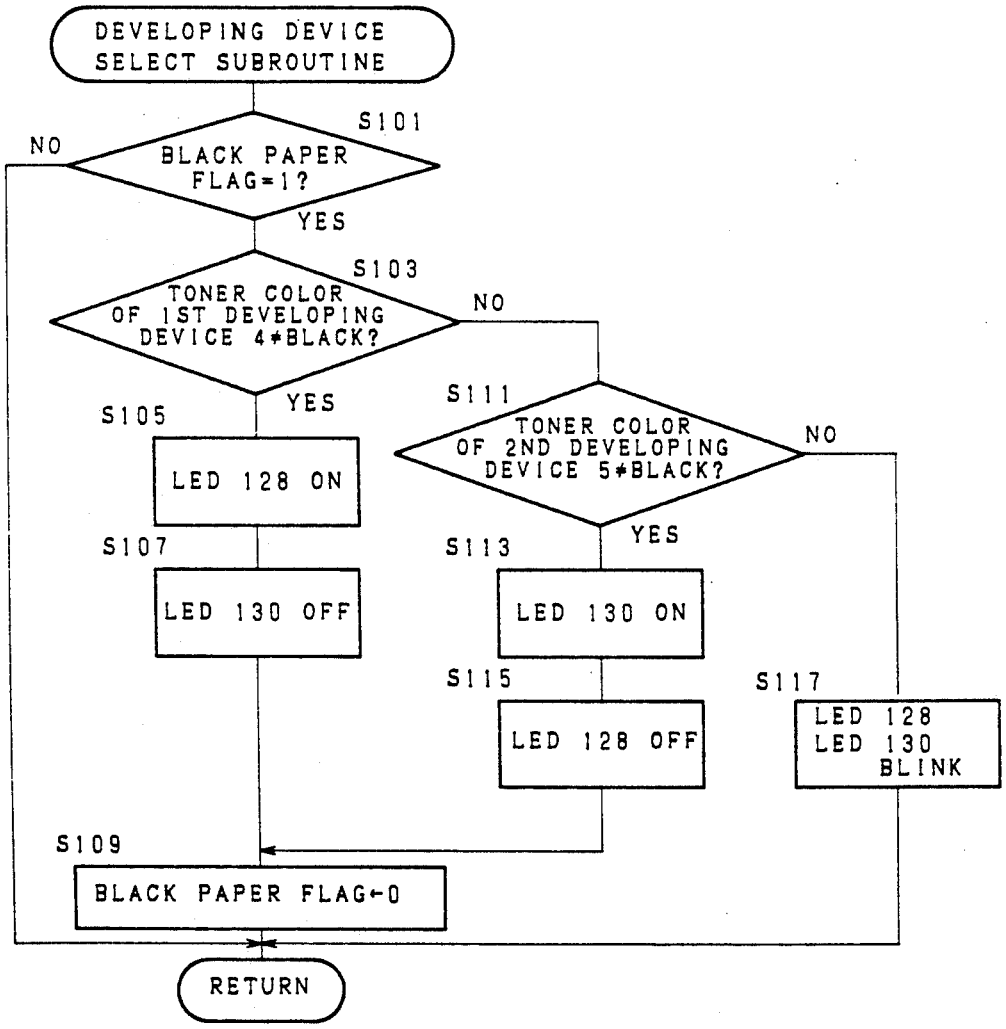
FIG. 21 is a flow chart showing a developing device selecting subroutine of the third embodiment, FIGS. 22 (A) and (B) are flow charts showing an input subroutine of the third embodiment.

FIG. 21 shows a flow chart of a developing device select subroutine.

(1) In S101, it is determined whether "1" is set or not in the "black" paper flag, if it is or the color of copying paper contained in the paper feed cassette selected is "black", in next S103, then it is determined whether the color of toner contained in the first developing device 4 is other than "black" or not. When the toner color in the first developing device 4 is other than "black" such as "white", the LED 128 displaying that the first developing device 4 is selected is ON in S105, and the LED 130 displaying that the second developing device 5 is selected is OFF in S107 to select the former, then the procedure returns to the main routine after setting the "black" paper flag at "0" in S109.

(2) When the toner color in the first developing device 4 is not other than "black" in S103, it is determined whether the color of toner contained in the second developing device 5 is other than "black" or not in S111. If the color other than "black" is determined, the LED 130 is ON in S113 and the LED 128 is OFF in S115 to select the second developing device 5, then the procedure returns to the main routine after setting the "black" paper flag at "0" in S109.

(3) Furthermore, when the toner color of the second developing device 5 is also not other than "black" in S111, it is determined that the "black" toner is contained in both the first and second developing devices 4, 5 and the procedure moves to S117. The developing device selecting display LEDs 128 and 130 are both displayed and blinked in S117 to display and warn that, the toner of different color from "black" is contained neither in the first nor second developing devices 4, 5 in spite of the "black" copying paper has been selected. Thereafter, the procedure returns to the main routine. When the "black" paper flag is not set at "1", or the "black" copying paper is not selected in S101, the procedure returns to the main routine skipping S103–S117.

INPUT SUBROUTINE

Figure 22:
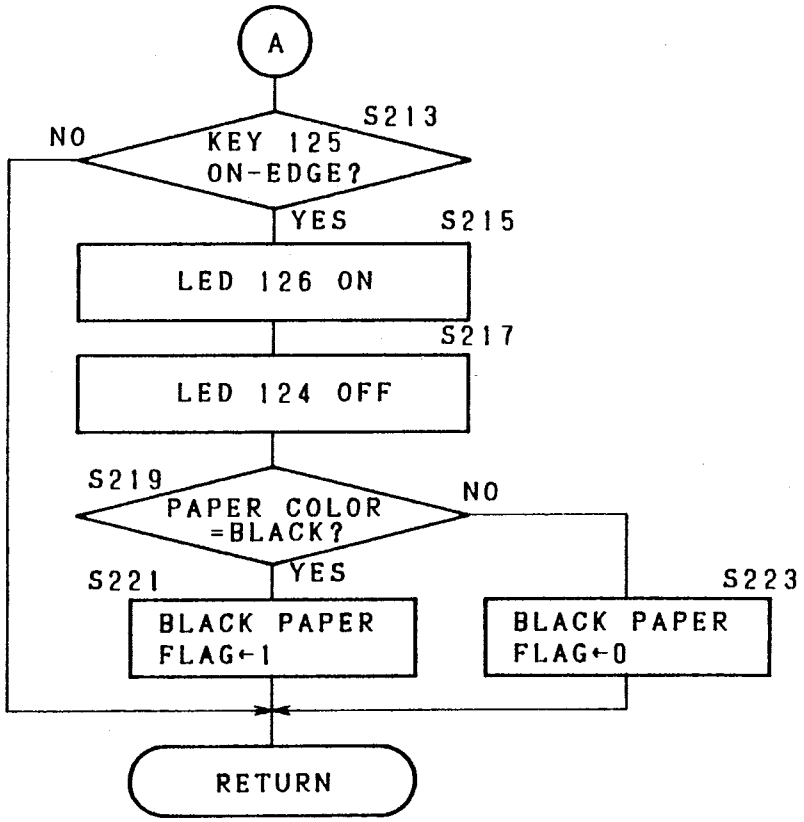
Figure 22:
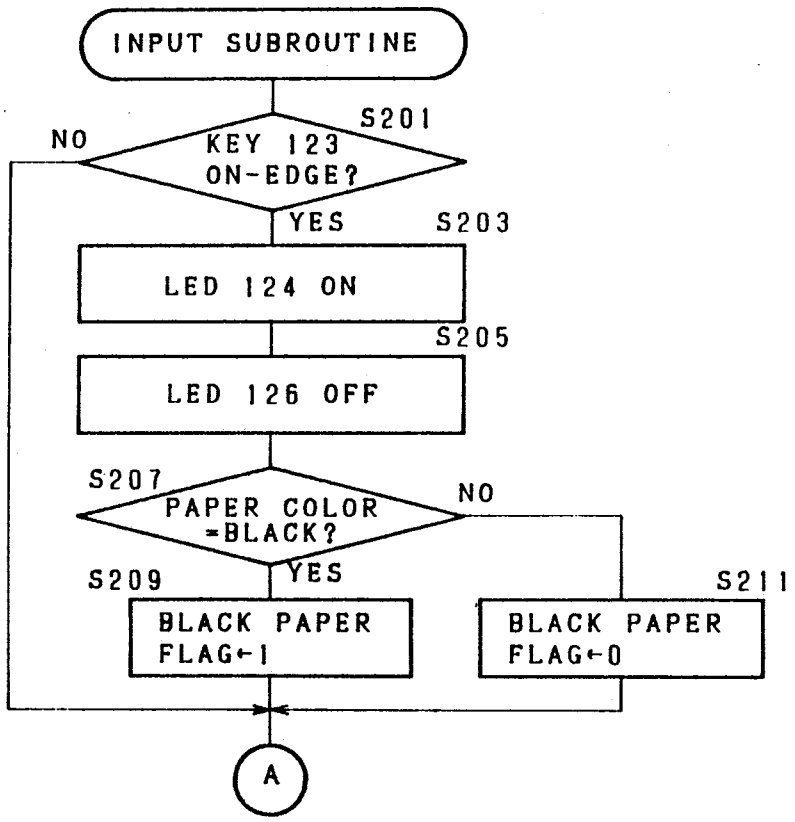

FIGS. 22 (A), (B) show flow charts of an input subroutine.

(1) In S201, it is determined whether the first paper feeder selecting key 123 is pressed or not, if it is, in S203, then the LED 124 displaying that the copying paper is fed from the first paper feed cassette 20*a* is ON, and moves to S207 after the LED 126 displaying that the second paper feeder 22 is selected is OFF in S205. Then, it is determined whether the color of copying paper contained in the first paper feed cassette 20*a* selected is "black" or not in S207, and if it is, then the procedure moves to S213 after setting "1" in the "black" paper flag in S209.

(2) If it is determined in S207 that the copying paper color is not "black", the procedure moves to S213 after setting the "black" paper flag at "0" in S211. When the first paper feeder selecting key 123 is not pressed in S201, the procedure moves to S213 skipping S203–S211.

(3) In S213, it is determined whether the second paper feeder selecting key 125 is pressed or not, if it is, in S215, then the LED 126 displaying that the copying paper is fed from the second paper feed cassette 22*a* is ON, and the procedure moves to S219 after the LED 124 displaying that the first paper feeder 20 is selected is OFF in S217. Then, in S219, it is determined whether the color of copying paper contained in the second paper feed cassette 22*a* is "black" or not, if it is, then the procedure returns to the main routine after setting the "black" paper flag at "1" in S221.

(4) If it is determined in S219 that the copying paper color is not "black", the procedure returns to the main routine after setting "0" in the "black" paper flag in S223. When the second paper feeder selecting key 125 is not pressed in S213, the procedure returns to the main routine skipping S215–S223.

In the aforesaid explanation, though it has been explained on the premise that the color of copying paper contained in the paper feed cassette is "black", and it will be appreciated that it is not limited thereto, the copying paper color other than "black" such as "white" can be processed similarly. It will be also appreciated that the present invention is not used restrictively to the copying machine including two developing devices 4, 5 and two paper feeders 20, 22 as explained heretofore, it may also be applicable to those having the developing device and paper feeder of one each or of three or more. Furthermore, aforesaid warning may be given not only in display but in message by the sound or suitable voice.

Next, the fourth embodiment of the present invention will be explained.

Figure 23:
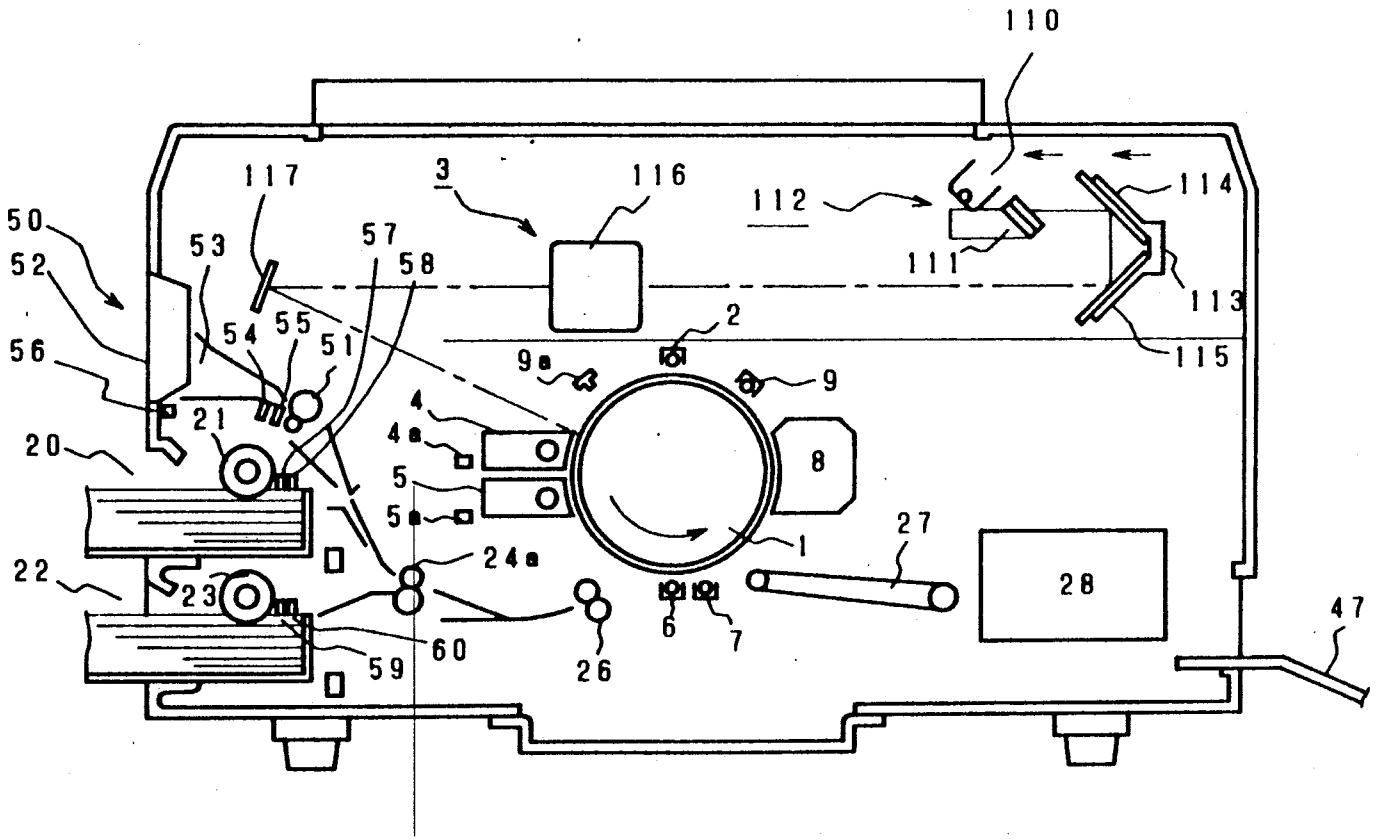
FIG. 23 is a schematic sectional view showing the construction of a copying machine of the fourth embodiment.

FIG. 23 is a schematic sectional view showing a copying machine of the fourth embodiment. Generally in the center of the copying machine there is provided an image forming portion with the photosensitive drum 1 as the main part thereof, above which an optical system 3, on the left hand side a paper feeder and on the right hand side a fixing device 28 are respectively disposed.

In the image forming portion, the photosensitive drum 1 is pivoted rotatably and a charger 2, inter-image eraser 9*a*, first and second developing devices 4, 5, transfer charger 6, separation charger 7, cleaning device 8 and eraser lamp 9 are arranged successively along the surrounding thereof.

The optical system 3 is constituted by a scanning unit 112 comprising a slit-exposure type light source 110 and a first movable mirror 111 integrated in one unit, second and third movable mirrors 114, 115 held by a common holder 113, variable magnification lens 116 and mirror 117.

The scanning unit 112 is driven by a DC motor not shown here to move leftward at the speed of (v/m)(where m: copying magnification) relative to the circumferential speed(v)(constant irrespective of equimultiple or variable magnitude) of the photosensitive drum 1, and the common holder 113 is to move leftward at the speed of (v/2 m). By such a scanning of the original image by the optical system 3, the photosensitive drum 1 receives the image exposure and form the electrostatic latent image. On said electrostatic latent image, a toner is adhered by either of first or second developing devices 4, 5 selected. In the vicinity of each first and second developing devices 4, 5, toner color discriminating sensors 4*a*, 5*a* for discriminating the toner color of the developing device are disposed to output the color code signal responsive to the toner color. The toner color discriminating sensors 4a, 5a may be constructed to comprise, for example, 3 switches which are ON and OFF respectively by a notch or the like formed on the side of developing device to output the color code signals of $2^3=8$ kinds, or to read from the magnetic or optical display provided on the developing device by elements responsive thereto.

The paper feed system includes a manual paper feeder 50 and first and second paper feeders 20, 22, and the conveying passage of copying paper is formed by a pair of manual paper feed rollers 51, pair of intermediate rollers 24a, first paper feed roller 21, second paper feed roller 23 and pair of timing rollers 26. The manual paper feeder 50 includes a manual paper feed inlet door 52 and a pair of manual paper feed rollers 51, whereby the copying paper can be inserted into a manual paper feed inlet 53 manually by drawing the manual paper feed inlet door 52 forward. Before the manual paper feed rollers 51, a contact-type paper detecting actuator 54 for detecting that the copying paper has been inserted and a transmission-type photo sensor 55 (only a luminous element is shown) are disposed.

The transmission-type photo sensor 55 comprising a receiving element and luminous element which are oppositely disposed via the paper is constructed to output the OFF signal in the case of OHP paper, and output the ON signal in the case of non-transparent paper. In the vicinity of the manual paper feed inlet door 52, a sensor 56 is disposed to detect its opening and closing state.

While, the first paper feeder 20 includes the first paper feed roller 21, in the vicinity of which, a transmission-type photo sensor 57 (only a luminous element is shown) as same as above-mentioned and a contact-type paper detecting actuator 58 are arranged. The second paper feeder 22 includes the second paper feed roller 23, in the vicinity of which, a transmission-type photo sensor 59 (only a luminous element is shown) and a contact-type paper detecting actuator 60 are arranged.

Though whether the paper contained in the paper feed cassette is transparent or not is detected by such transmission-type photo sensors 57, 59, it may be constructed as such that, for example, as shown in the first embodiment, any color of paper color including the transparent paper contained in the paper feed cassette can be discriminated. It is also possible to dispose the transmission-type photo sensor, for example, near the intermediate rollers 24a to discriminate whether the paper fed one by one is transparent or not. When discriminating one by one as such, it is possible to cope with the case even when the transparent and non-transparent paper are mixed in the paper feed cassette.

The pair of timing rollers 26 send out the copying paper conveyed from the paper feeder in alignment with the toner image forming area formed on the photosensitive drum 1 at its front end. The copying paper thus sent out is transferred with a toner image by the transfer charger 6, and peeled off from the photosensitive drum 1 by the separation charger 7. Then, it is discharged to a discharging tray 47 outside the copying machine via the conveying belt 27 after the toner being melted and fixed by the fixing device 24.

Figure 24:
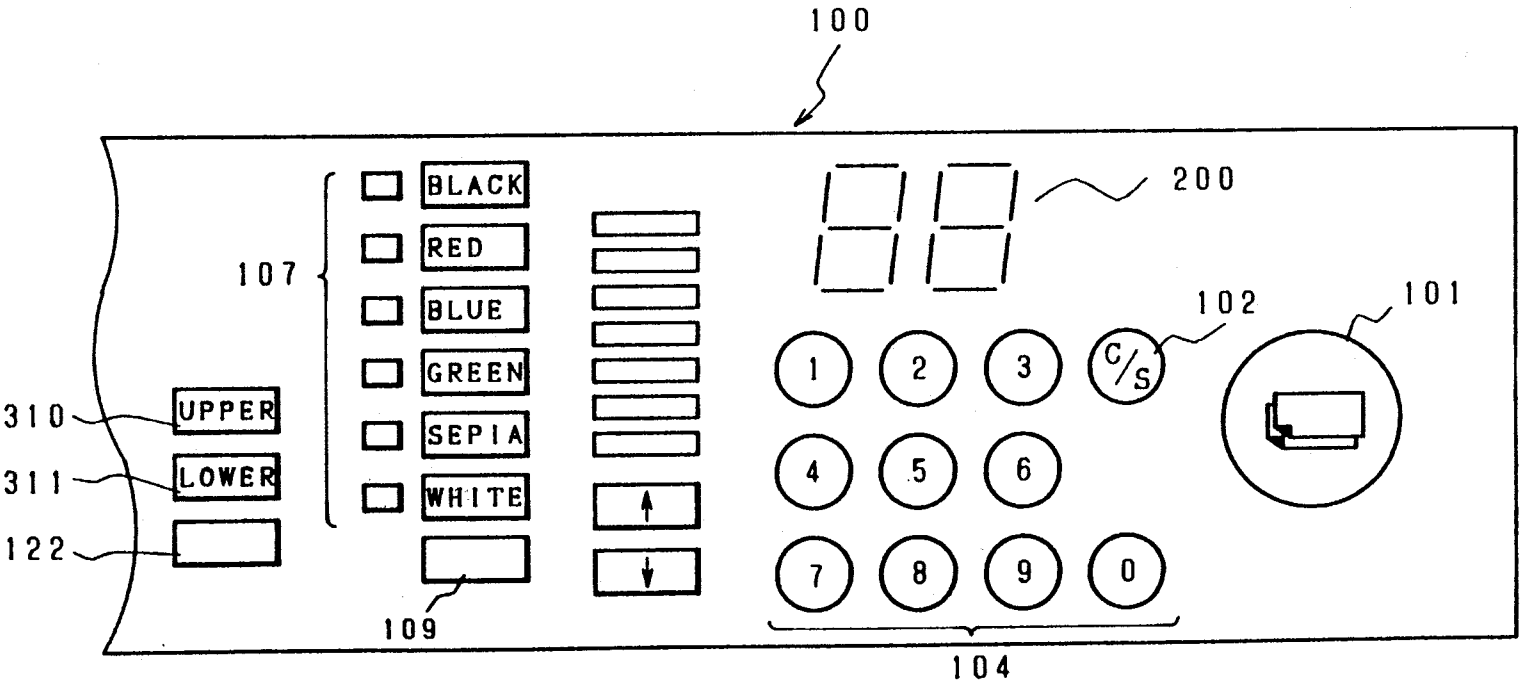
FIG. 24 is an enlarged plan view showing a portion of an operating panel of a copying machine of the fourth embodiment.

FIG. 24 is a plan view showing a portion of an operating panel 100 of the copying machine. The operating panel 100 is arranged in the upper front of the copying machine and provided with a print key 101 for starting the copying operation and so on, ten-key group 104 for registering the number of copies, etc., clear/stop key 102 for inputting the signal to clear the number of copies set, stop the copying operation and so on, numerical display 200 for displaying the number of copies and so on, developing device selecting key 109 for selecting either of the developing devices mounted, toner color displays 107 for displaying the toner color in the developing device selected by the key 109, cassette selecting key 122 for selecting either the first paper feeder (upper cassette) 20 or the second paper feeder (lower cassette) 22, LEDs 310, 311 for displaying whether the cassette selected is the upper one or the lower one, and others.

Figure 25:
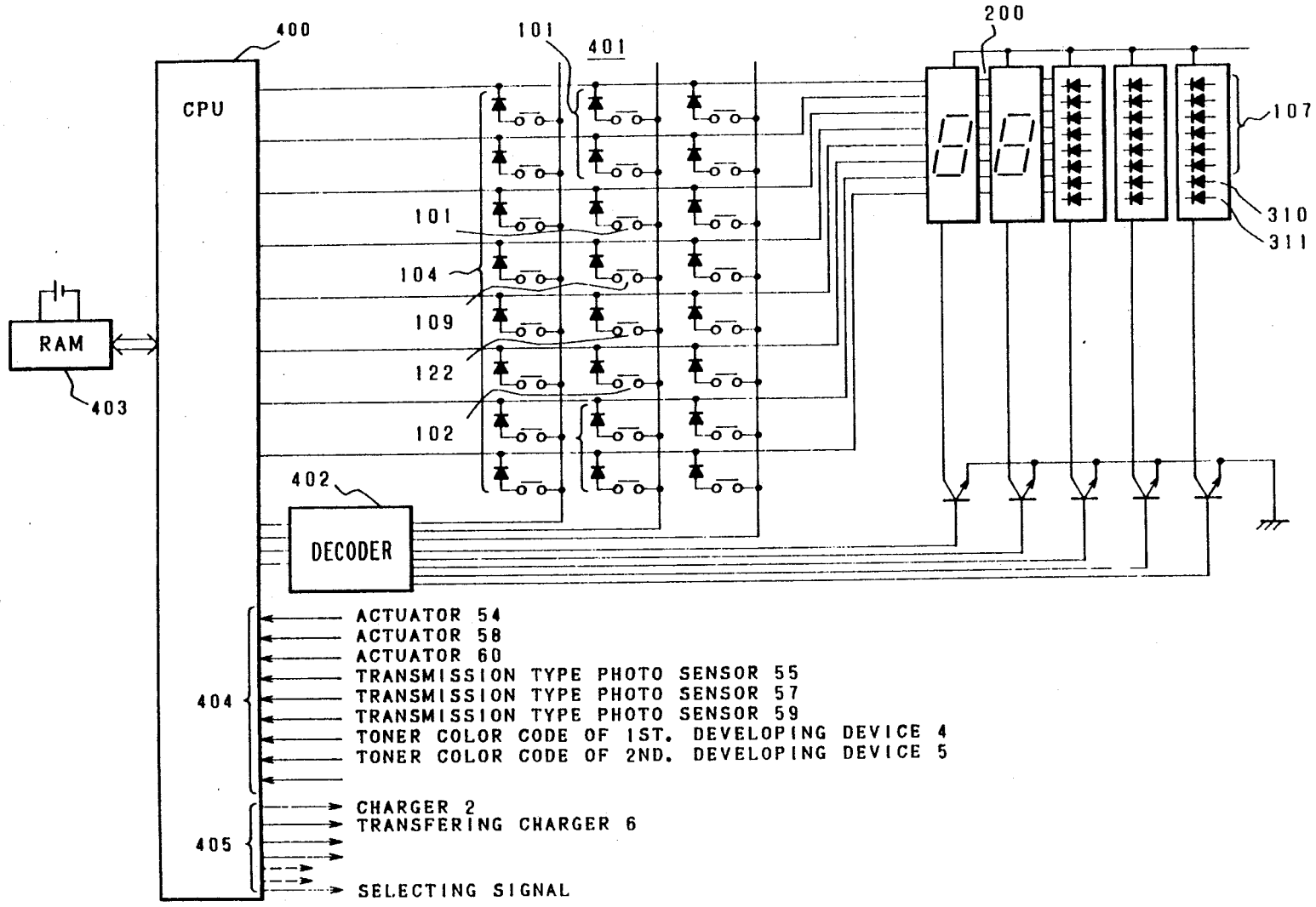
FIG. 25 is an input-output construction view of a control circuit for controlling a copying machine of the fourth embodiment.

FIG. 25 shows an input-output configuration of a control circuit which controls the copying machine 1. The control circuit is constituted mainly by a CPU 400. To the CPU 400, a switch matrix 401 in which switches or the like on the operating panel 100 are arranged in all directions, numerical display 200 on the operating panel 100 of the copying machine and lighting circuits of LEDs of the displays 107 are connected through the decoder 402. It is also connected to a RAM 403 backed up by a battery via bus lines.

To a signal input portion 404, output signals of the paper detecting actuators 54, 58, 60, transmission-type photo sensors 55, 57, 59 and manual paper feed inlet door opening and closing state sensor 56 are inputted. The toner colors of the first and second developing devices 4, 5 are also inputted by the code signals.

Furthermore, from a signal output portion 405, control signals are outputted to image forming elements such as the charger 2, transfer charger 6, optical system 3 etc., and a selecting signal for selecting either of the first and second developing devices 4, 5 is outputted.

Figure 26:
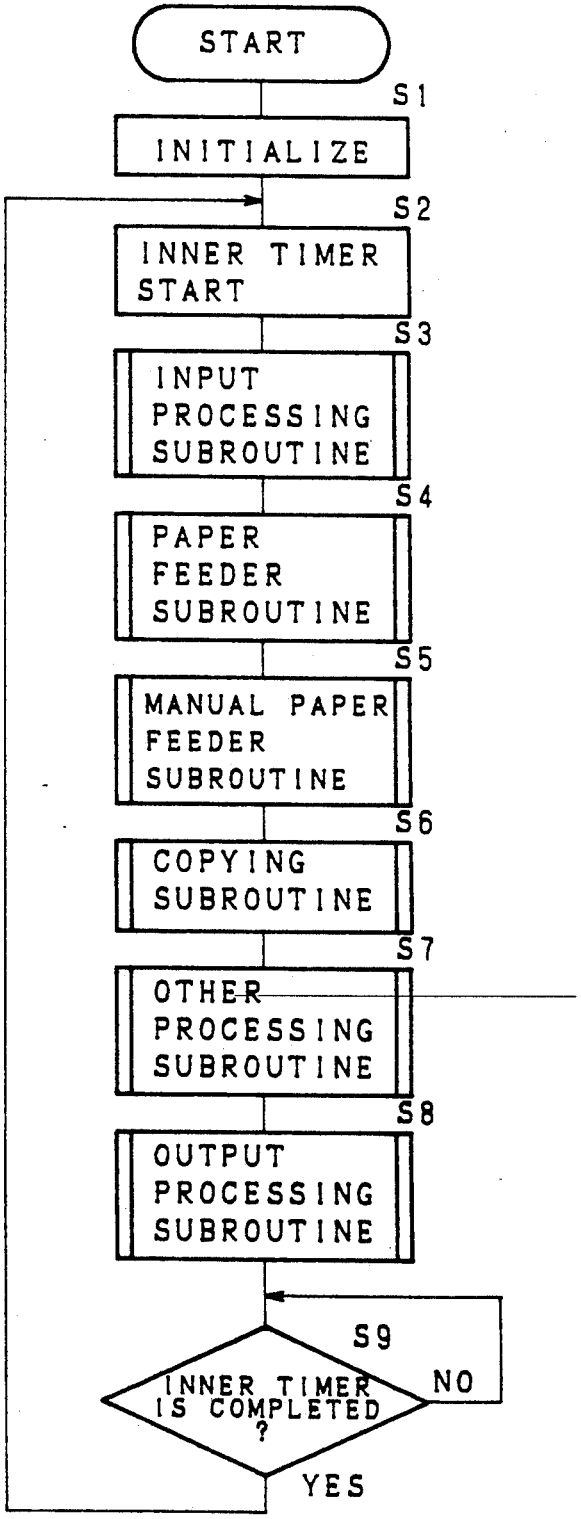
FIG. 26 is a flow chart showing a main routine of a CPU.

FIG. 26 is a flow chart showing the main routine of the CPU 400.

The CPU 400 is first set in an initial mode by putting on a power supply (S1) etc., whereby various registers, flags and so on are set in the initial mode and data stored in the RAM 403 are cleared if necessary. Next, an inner timer for regulating the time of one routine is set (S2), and the following input processing subroutine (S3), cassette paper feeder processing subroutine (S4), manual paper feeder processing subroutine (S5), copying operation subroutine (S6), output processing subroutine (S7) and the other processing subroutine (S8) are successively executed, and the procedure returns to S2 after the completion of inner timer set in S2 (S9).

Figure 27:
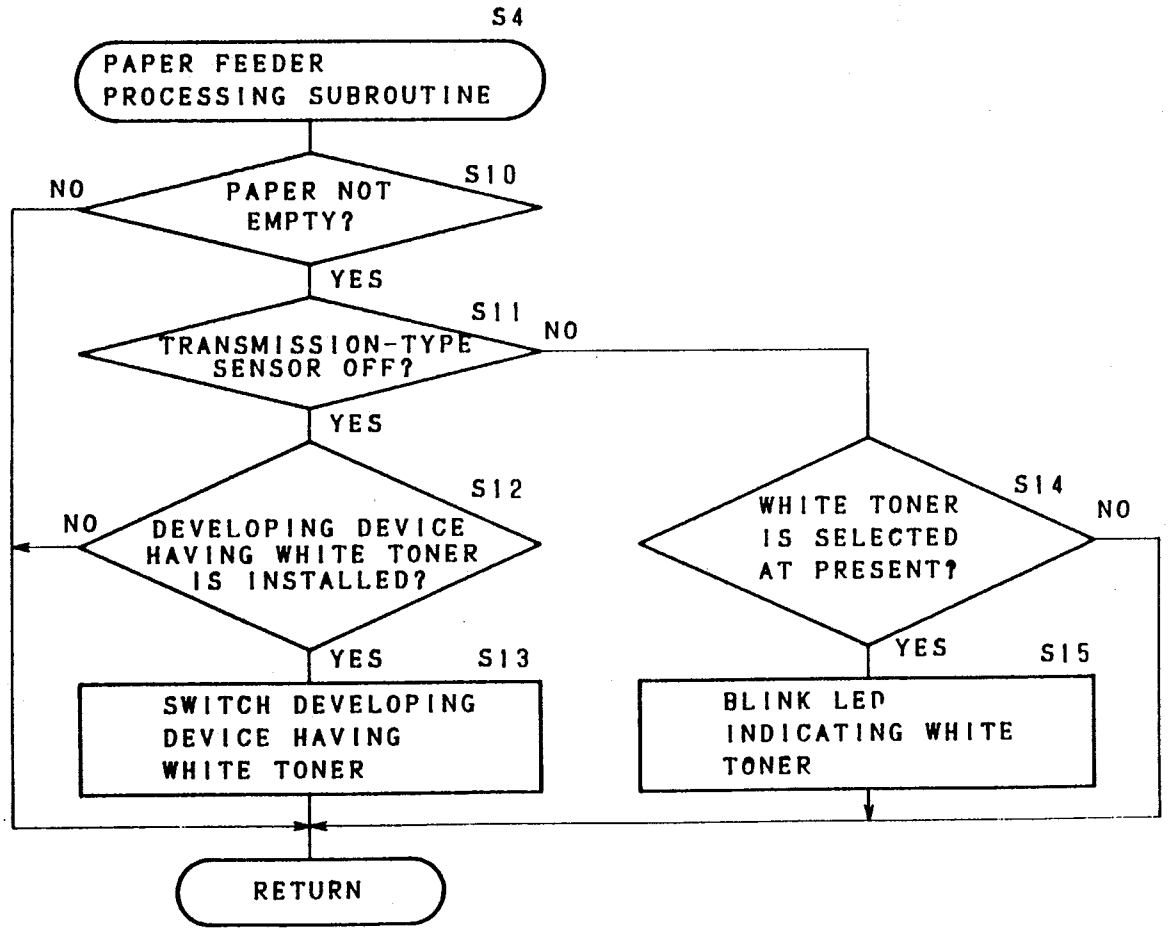
FIG. 27 is a flow chart showing a cassette paper feeder processing routine.

FIG. 27 is a flow chart showing a portion of the cassette paper feeder processing subroutine (S4). First, it is determined whether paper is present in the paper feed cassette selected or not by the output signal of the contact-type actuator 58 or 60 disposed at the cassette paper feeder (S10). If the paper is present, the output signal of the transmission-type photo sensor 57 or 59 disposed at the cassette paper feeder selected is determined. When it is OFF, or the paper is transparent (e.g. OHP paper), whether the developing device having the white toner is mounted or not is discriminated by the color code signal read from the developing device 4 or 5 (S12). When the developing device having the white toner is installed, this developing device is selected (S13).

In S11, when the output signal of the transmission-type photo sensor 57 or 59 is ON, or the paper is non-transparent, it is determined whether the white toner is selected at present or not by the color code signal (S14). When the cassette containing the non-transparent paper is selected and the white toner is selected, the LED of the toner color display 107 which indicates the white toner is blinked to warn display (S15).

Figure 28:
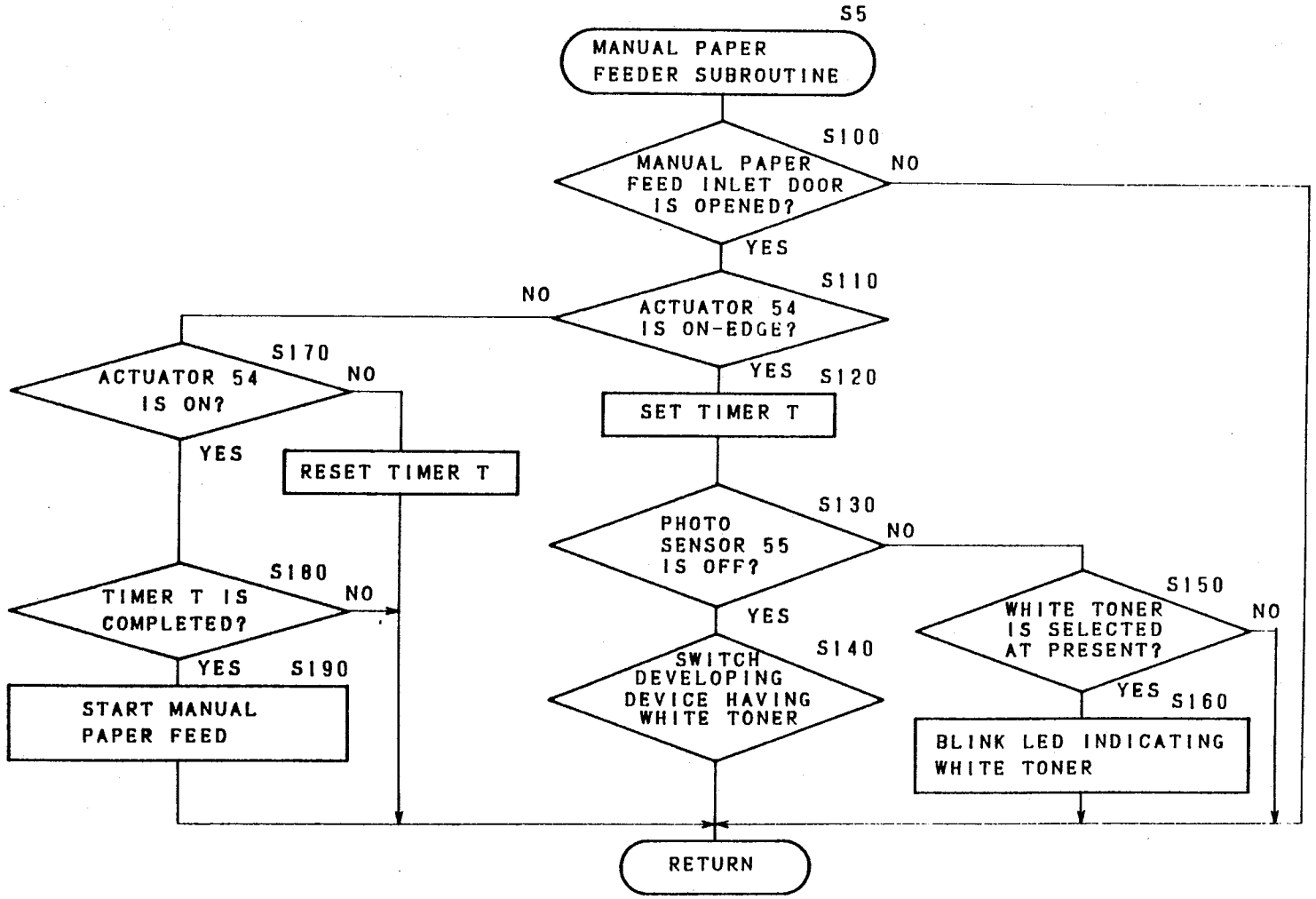
FIG. 28 is a flow chart showing a manual paper feeder processing routine.

FIG. 28 is a flow chart particularly showing a manual paper feed subroutine. First, it is determined whether the manual paper feed inlet door 52 is opened or closed by the manual paper feed inlet door detecting sensor 56 (S100), if it is closed, then the procedure returns to the main routine to execute the ordinary copying operation.

When the manual paper feed inlet door 52 is opened, it is determined whether the paper is inserted into the manual paper feed inlet 53 or not by the paper detecting actuator 54. When there is the output signal on-edge of the paper detecting sensor 54 or the paper is inserted, a timer T is set (S120). The timer T is for controlling to start manual copying when the paper is inserted into the manual paper feeder for more than the fixed time. Next, it is determined whether the output signal of the transmission-type photo sensor 55 is OFF or not (S130), if the output signal is OFF, assuming that the paper is transparent such as OHP paper, then the developing device containing the white toner is selected if any. If there is no developing device containing the white toner, the development is executed by the developing device selected at present.

When the output signal of the transmission-type photo sensor 55 is ON, it is determined whether the developing device selected at present contains the white toner or not by the color code signal (S150). When the developing device contains the white toner, the LED of the toner color display 107 which indicates the white toner is blinked (S160). That is, when the output signal of the transmission-type photo sensor 55 is ON, the paper inserted into the manual paper feeder 53 is non-transparent and, usually, the white copying paper. Since the image formed on the white paper by the white toner is indistinguishable, the LED of the toner color display 107 which indicates the white toner is blinked to warn display.

Now, in S110, when there is no output signal on-edge of the paper detecting actuator 54, whether its output signal is ON or not is determined (S170), if it is, it is determined whether the timer T set in S120 or not is determined (S180). When the timer T is completed, manual copying is started (S190). That is, when the paper is inserted into the manual paper feed inlet 53 for the prescribed time of the timer T, the manual paper feed rollers 51 are driven to rotate. Then, the paper is sent out as being clamped by the pair of manual paper feed rollers 51 and fed to the image forming portion through the pair of intermediate rollers **24*a* and pair of timing rollers 26**.

In S170, when the paper detecting actuator 54 is not ON, the timer T is reset (S200).

In the aforesaid embodiment, when the transparent paper such as OHP paper is fed, the developing device having the white toner is selected automatically. Therefore, it is not necessary to select the white toner manually, resulting in improvement of operation easiness and prevention of miscopying.

However, the present invention is not limited to the case where the developing device having the white toner is selected, the other toner color such as the toner containing a fluorescent dye which is easily visible in the dark as same as the white toner may be selected.

In the embodiment described hereinabove, in the processing of microcomputer, though the white toner is selected in advance from a standpoint of the software, the toner color for transparent paper may be adapted to designate from the outside. For example, by providing a button for designating the toner color used exclusively for the transparent paper on the operating panel 100, and pressing it after selecting any toner color, the designated color is stored in the RAM 403 as the toner color for the transparent paper.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. An image forming apparatus comprising, a photosensitive member;

means for forming an electrostatic latent image of an original on said photosensitive member;

a developing means including a plurality of developing devices for developing the electrostatic latent image on said photosensitive member, wherein each developing device contains the different color of developer;

a paper feed means for feeding copying paper whereon a developed image is transferred;

a first detecting means for detecting the color of developer in each of said developing devices;

a second detecting means for detecting the color of said copying paper to be fed; and an automatic selecting means for selecting the developing device containing the developer of different color from the color of copying paper.

2. An image forming apparatus comprising, a photosensitive member;

means for forming an electrostatic latent image of an original on said photosensitive member;

a developing means including a plurality of developing devices for developing an electrostatic latent image on said photosensitive member, wherein each developing device contains the different color of developer;

a paper feed means for feeding copying paper whereon a developed image is transferred;

a first detecting means for detecting the color of developer in each of said developing devices;

a second detecting means for detecting the color of said copying paper to be fed;

a priority ranking means for ranking priority of the colors of developer to be used relative to said color of copying paper; and an automatic selecting means for selecting the developing device containing the developer of first priority color among said developing devices.

3. An image forming apparatus as set forth in Claim 2, wherein said priority ranking means ranks priority to said colors of developers in response to a hue and/or color density between said color of copying paper and said color of developer.

4. An image forming apparatus comprising, a photosensitive member;

means for forming an electrostatic latent image of an original on said photosensitive member;

a developing means including a plurality of developing devices for developing the electrostatic latent image on said photosensitive member, wherein each developing device contains a different kind of developer;

a paper feed means for feeding copying paper whereon the developed image is transferred;

a first detecting means for detecting the kind of developer in each of said developing devices;

a second detecting means for detecting the kind of said copying paper to be fed; and an automatic selecting means for selecting the developing device containing the kind of developer responsive to the kind of copying paper.

5. an image forming apparatus as set forth in claim 4, wherein said first detecting means also detects whether the color of developer is the prescribed color or not.

6. An image forming apparatus comprising, a photosensitive member;

means for forming an electrostatic latent image of an original on said photosensitive member;

a developing means including a plurality of developing devices for developing the electrostatic latent image on said photosensitive member, wherein at least one of the developing devices contains a white developer;

a paper feed means for feeding copying paper whereon the developed image is transferred;

a first detecting means for detecting the color of developer in each of said developing devices;

a second detecting means for detecting the kind of said copying paper; and an automatic selecting means for selecting the developing device containing a white developer, when the copying paper consisting of a transparent material is detected by said second detecting means.

7. An image forming apparatus comprising, a photosensitive member;

means for forming an electrostatic latent image of an original on said photosensitive member;

a developing means including a plurality of developing devices for developing the electrostatic latent image on said photosensitive member, wherein each developing device contains the different color of developer;

a paper feed means including a plurality of paper feeders for feeding copying paper whereon the developed image is transferred, wherein each paper feeder contains the different color of copying paper;

a first detecting means for detecting the color of developer in each of said developing devices;

a second detecting means for detecting the color of copying paper in each of said paper feeder;

a manual selecting means for selecting one of a plurality of paper feeders manually;

a priority ranking means for ranking priority of the colors of developer to be used relative to the color of copying paper in the selected paper feeder; and an automatic selecting means for selecting the developing device containing the developer of first priority color among said developing devices.

8. An image forming apparatus as set forth in claim 7, wherein said priority ranking means ranks priority to said colors of developers in response to a hue and/or color density between said color of copying paper and the color of developer.

9. An image forming apparatus comprising, a photosensitive member;

an original table having a rectangular original placing surface;

a scanning means for scanning an original to form an electrostatic latent image on said photosensitive member as moving relatively from one end to the other end of said original table;

a positioning means being movable along a side of said original table;

a signal generating means for generating a signal when said scanning means passes a position indicated by said positioning means while moving;

a developing means including two developing devices containing different colors of developers to develop the electrostatic latent image on said photosensitive member;

a first selecting means for selecting one of said two developing devices;

a second selecting means for selecting either first or second mode, wherein said first mode is the mode in which development is performed using the developing device selected by said first selecting means, and said second mode is the mode in which development is performed using said two developing devices;

a switching means for starting development by using either of the two developing devices at said second mode, and in response to said signal, stopping the operation of developing device and, at the same time, starting the operation of the other developing device;

a paper feed means for feeding a copying paper whereon an image formed on said photosensitive member is transferred;

a first detecting means for detecting the color of developer in each of said developing devices;

a second detecting means for detecting the color of said copying paper to be fed; and a control means for canceling said second mode and selecting said first mode to select the developing device containing the developer of different color from that of said copying paper, when the color of said copying paper and the color of developer in at least one of said developing devices are same at said second mode.

10. An image forming apparatus as set forth in claim 9, wherein said first detecting means includes a plurality of reed switches provided on each of said developing devices, and means for reading a first code generated in response to combination of their opening and closing state.

11. An image forming apparatus as set forth in claim 10, wherein said second detecting means includes a plurality of reed switches provided on said paper feed means, and means for reading a second code generated in response to combination of their opening and closing state.

12. An image forming apparatus as set forth in claim 11, wherein said control means cancels said second mode and selects said first mode to select the developing device containing the developer of different color from that of said copying paper, when said first and second codes are same.

13. An image forming apparatus comprising, a photosensitive member;

an original table having a rectangular original placing surface;

means for forming an electrostatic latent image of an original on said photosensitive member;

a developing means including two developing devices containing different colors of developers to develop an electrostatic latent image on said photosensitive member;

a first selecting means for selecting one of said two developing devices;

a second selecting means for selecting either a first or second mode, wherein said first mode is the mode in which development is performed using the developing device selected by the first selecting means, and said second mode is the mode in which development is performed using the two developing devices;

a paper feed means for feeding copying paper whereon an image formed on said photosensitive member is transferred;

a first detecting means for detecting the color of developer in each of said developing devices;

a second detecting means for detecting the color of said copying paper to be fed; and a control means for canceling said second mode and selecting said first mode to select the developing device containing the developer of different color from that of said copying paper, when the color of said copying paper and the color of developer in at least one of said developing devices are same at said second mode.

* * * * *